US012043953B2

(12) United States Patent
Chae et al.

(10) Patent No.: US 12,043,953 B2
(45) Date of Patent: Jul. 23, 2024

(54) GARMENT FOLDING MACHINE AND METHOD OF CONTROLLING THE SAME

(71) Applicant: LG Electronics Inc., Seoul (KR)

(72) Inventors: Kyosoon Chae, Seoul (KR); Keun Joo Kim, Seoul (KR); Sung Hoon Ahn, Seoul (KR); Choongho Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 446 days.

(21) Appl. No.: 17/329,997

(22) Filed: May 25, 2021

(65) Prior Publication Data

US 2021/0363685 A1 Nov. 25, 2021

(30) Foreign Application Priority Data

May 25, 2020 (KR) ..... 10-2020-0062395

(51) Int. Cl.
*D06F 89/02* (2006.01)
*B65H 5/02* (2006.01)
*B65H 37/06* (2006.01)

(52) U.S. Cl.
CPC ..... *D06F 89/02* (2013.01); *B65H 5/021* (2013.01); *B65H 37/06* (2013.01); *B65H 2553/82* (2013.01)

(58) Field of Classification Search
CPC .. A41H 43/025; A41H 43/0257; B65H 5/021; B65H 37/06; B65H 2553/82; D06F 89/00; D06F 89/02; D06F 89/023
See application file for complete search history.

(56) References Cited

U.S. PATENT DOCUMENTS

| | | | | |
|---|---|---|---|---|
| 5,300,007 | A * | 4/1994 | Kober | D06F 89/00 493/450 |
| 9,365,971 | B2 * | 6/2016 | Heinz | D06F 89/00 |
| 2019/0292718 | A1 * | 9/2019 | Maeshima | D06F 89/00 |
| 2020/0248397 | A1 * | 8/2020 | Nitschmann | B65H 29/16 |
| 2020/0385918 | A1 * | 12/2020 | Naor | D06F 89/00 |

FOREIGN PATENT DOCUMENTS

| | | |
|---|---|---|
| JP | 2005131005 | 5/2005 |
| JP | 2016150025 | 8/2016 |
| KR | 20200028826 | 3/2020 |
| KR | 20200038620 | 4/2020 |
| KR | 20200042936 | 4/2020 |

OTHER PUBLICATIONS

International Search Report in International Appln. No. PCT/KR2021/006405, dated Sep. 24, 2021, 7 pages (with English translation).

* cited by examiner

*Primary Examiner* — F Griffin Hall
(74) *Attorney, Agent, or Firm* — Fish & Richardson P.C.

(57) ABSTRACT

The present disclosure relates to a method of controlling a garment folding machine having a plurality of folding layers configured to perform a function of folding a garment or a function of conveying the garment using at least one conveyor, and the method includes a wrinkle removing step of operating a conveyor motor to allow the conveyor to drop one end of the garment from the conveyor, thereby removing wrinkles of the garment using a weight of the garment.

9 Claims, 20 Drawing Sheets

GARMENT FOLDING MACHINE AND METHOD OF CONTROLLING THE SAME

CROSS-REFERENCE TO RELATED APPLICATION

This application claims the benefit of priority to Korean Application No. 10-2020-0062395, filed on May 25, 2020, the disclosure of which is incorporated by reference in its entirety.

TECHNICAL FIELD

The present disclosure relates to a garment folding machine and a method of controlling the same, and more particularly, to a garment folding machine and a method of controlling the same, which are capable of removing wrinkles of a garment which are formed during a process of conveying and folding the garment.

BACKGROUND

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. In a case in which the garments are folded by unskilled persons, the shapes and the sizes of the folded garments are not uniform, which causes a problem in that additional labor is required to fold the garments for the purpose of displaying or storing the garments.

Therefore, there is a gradually increasing need for an automatic folding machine capable of quickly folding a garment without variation.

Regarding the garment folding machine in the related art, International Patent Publication No. 2018-122841 (hereinafter, referred to as a 'related art document') discloses a configuration of a folding machine in which a garment is loaded from above, folded, and then discharged while moving downward and passing through a plurality of folding layers stacked in multiple stages.

However, in the case of the folding machine disclosed in the related art document, lower garments, which have long lengths among garments C, towels, or bedclothes are conveyed along the two or more folding layers and may be wrinkled during the conveying process.

In particular, in the case of the domestic garment folding machine as disclosed in the related art document, the plurality of layers is vertically disposed in a narrow horizontal area due to a spatial restriction, spaces between the layers are narrow, and many components are provided to convey the garments between the layers. For this reason, the garment C is easily wrinkled during the process of conveying the garment C.

SUMMARY

The present disclosure has been made in an effort to solve the above-mentioned problems, and an object of the present disclosure is to provide a garment folding machine and a method of controlling the same, which are capable of preventing a garment having a long length from being crumpled and wrinkled during a process of folding the garment.

In one aspect, the present disclosure provides a garment folding machine including: a frame unit configured to define an external framework; a loading unit into which a garment is loaded; a folding unit configured to convey and fold the loaded garment; an unloading unit configured to collect the garment folded by the folding unit; and a control unit configured to control the folding unit.

The folding unit may include: a first folding layer; a second folding layer disposed below the first folding layer and provided to perform vertical folding on the garment; and a third folding layer disposed below the second folding layer and provided to perform horizontal folding on the garment.

The third folding layer may include: a third conveyor configured to convey the garment, passing through the second folding layer, to a front end or a rear end thereof; and a third conveyor motor configured to provide driving power to the third conveyor.

The control unit may operate the third conveyor motor to drop one end of the garment to the outside of the front end of the third conveyor.

The second folding layer may include: a second conveyor configured to convey the garment, passing through the first folding layer, from a rear end to a front end thereof; a second conveyor motor configured to provide driving power to the second conveyor; and a second-conveyor-front-end garment detection sensor disposed at the front end of the second conveyor and configured to detect whether the garment is present at a target position and generate a detection signal.

The control unit may operate the third conveyor motor when the control unit receives the detection signal from the second-conveyor-front-end garment detection sensor.

The third folding layer may further include a third-conveyor-rear-end garment detection sensor disposed at the rear end of the third conveyor and configured to detect whether the garment is present at the target position and generate a detection signal.

The control unit may calculate a length of the garment using a garment passage time made by measuring a time from a point in time at which the control unit begins to receive the detection signal from the third-conveyor-rear-end garment detection sensor to a point in time at which the reception of the detection signal.

When the reception of the detection signal from the third-conveyor-rear-end garment detection sensor is stopped, the control unit may change a rotation direction of the third conveyor motor to convey the garment from the rear end to the front end of the third conveyor.

The control unit may operate the third conveyor motor to convey the garment from the rear end to the front end of the third conveyor, and an operating time of the third conveyor motor may be ⅓ or more and ⅔ or less of the garment passage time.

The folding unit may further include a fourth folding layer disposed below the third folding layer and provided to perform horizontal folding on the garment.

The fourth folding layer may include: a fifth conveyor configured to convey the garment to a front end or a rear end thereof; a fifth conveyor motor configured to provide driving power to the fifth conveyor; and a fifth-conveyor-front-end garment detection sensor disposed at the front end of the fifth conveyor and configured to detect whether the garment is present at the target position and generate a detection signal.

The control unit may operate the fifth conveyor motor to convey the garment to the rear end of the fifth conveyor, and when the reception of the detection signal from the fifth-conveyor-front-end garment detection sensor is stopped, the control unit may change a rotation direction of the fifth conveyor motor.

The fourth folding layer may further include: a seventh conveyor disposed at a front side of the fifth conveyor and configured to convey the garment to a front end or a rear end thereof; a seventh conveyor motor configured to provide driving power to the seventh conveyor; and a seventh-conveyor-rear-end garment detection sensor disposed at the rear end of the seventh conveyor and configured to detect whether the garment is present at the target position and generate a detection signal.

The control unit may operate the seventh conveyor motor to convey the garment to the front end of the seventh conveyor, and when the reception of the detection signal from the seventh-conveyor-rear-end garment detection sensor is stopped, the control unit may change a rotation direction of the seventh conveyor motor.

The third folding layer may further include: a fourth conveyor disposed at a rear side of the third conveyor and configured to convey the garment or perform horizontal folding on the garment; and a fourth conveyor motor configured to provide driving power to the fourth conveyor.

When the reception of the detection signal from the third-conveyor-rear-end garment detection sensor is stopped, the control unit may operate the fourth conveyor motor to convey the garment from a rear end to a front end of the fourth conveyor, and an operating time of the fourth conveyor motor may be ⅓ or more and ⅔ or less of the garment passage time.

During the horizontal folding, the control unit may operate the third conveyor motor to convey one end of the garment from the front end to the rear end of the third conveyor and operate the fourth conveyor motor to convey the other end of the garment from the rear end to the front end of the fourth conveyor.

The fourth folding layer may further include: a sixth conveyor disposed between the fifth conveyor and the seventh conveyor and configured to convey the garment or perform horizontal folding on the garment; and a sixth conveyor motor configured to provide driving power to the sixth conveyor.

The control unit may control the sixth conveyor motor so that a rotation direction of the sixth conveyor is opposite to a rotation direction of the fifth conveyor or control the sixth conveyor motor so that a rotation direction of the sixth conveyor is opposite to a rotation direction of the seventh conveyor in order to perform the horizontal folding on the garment.

In another aspect, the present disclosure provides a method of controlling a garment folding machine having a plurality of folding layers configured to perform a function of folding a garment or a function of conveying the garment using at least one conveyor, the method including: a wrinkle removing step of operating a conveyor motor to allow the conveyor to drop one end of the garment from the conveyor.

The wrinkle removing step may include a vertical-movement wrinkle removing step of operating the conveyor motors in the plurality of folding layers to drop one end of the garment from the conveyor while conveying the garment between the plurality of folding layers disposed in an upward/downward direction.

The method may further include a garment detecting step of detecting the presence or absence of the garment using a sensor disposed at one side of the conveyor while conveying the garment by operating the conveyor motor.

In the garment detecting step, a length of the garment may be calculated using a conveying speed of the conveyor and a time for which the garment is conveyed to one side of the conveyor and the garment is loaded to the conveyor and completely passes through the conveyor.

The wrinkle removing step may include a horizontal-movement wrinkle removing step of conveying the garment to the other side of the conveyor and dropping one end of the garment from the conveyor.

In the horizontal-movement wrinkle removing step, one end of the garment may be conveyed from one side of the conveyor to the other side of the conveyor, and the garment may be conveyed by a distance corresponding to ⅓ or more and ⅔ or less of the length of the garment.

The horizontal-movement wrinkle removing step may stop conveying the garment when reception of a detection signal indicating that the garment is present is stopped after the detection signal is received from the sensor.

The horizontal-movement wrinkle removing step may change a conveyance direction of the garment when the reception of the detection signal is stopped.

The method may further include a horizontal folding step of performing, after the horizontal-movement wrinkle removing step, horizontal folding on the garment by rotating, in opposite directions, the plurality of conveyors disposed in a forward/rearward direction.

In the vertical-movement wrinkle removing step, a rotational speed of the conveyor motor disposed at a lower side may be higher than a rotational speed of the conveyor motor disposed at an upper side.

According to the garment folding machine and the method of controlling the same according to the present disclosure, an end of a garment having a long length is dropped to the outside of the conveyor during a process of conveying the garment, such that wrinkles of the garment may be removed by a weight of the garment.

In addition, a conveyance direction of the garment is changed in the state in which the end of the garment is dropped to the outside of the conveyor, such that wrinkles of the garment may be removed by inertia.

DETAILED DESCRIPTION

Figure 1:
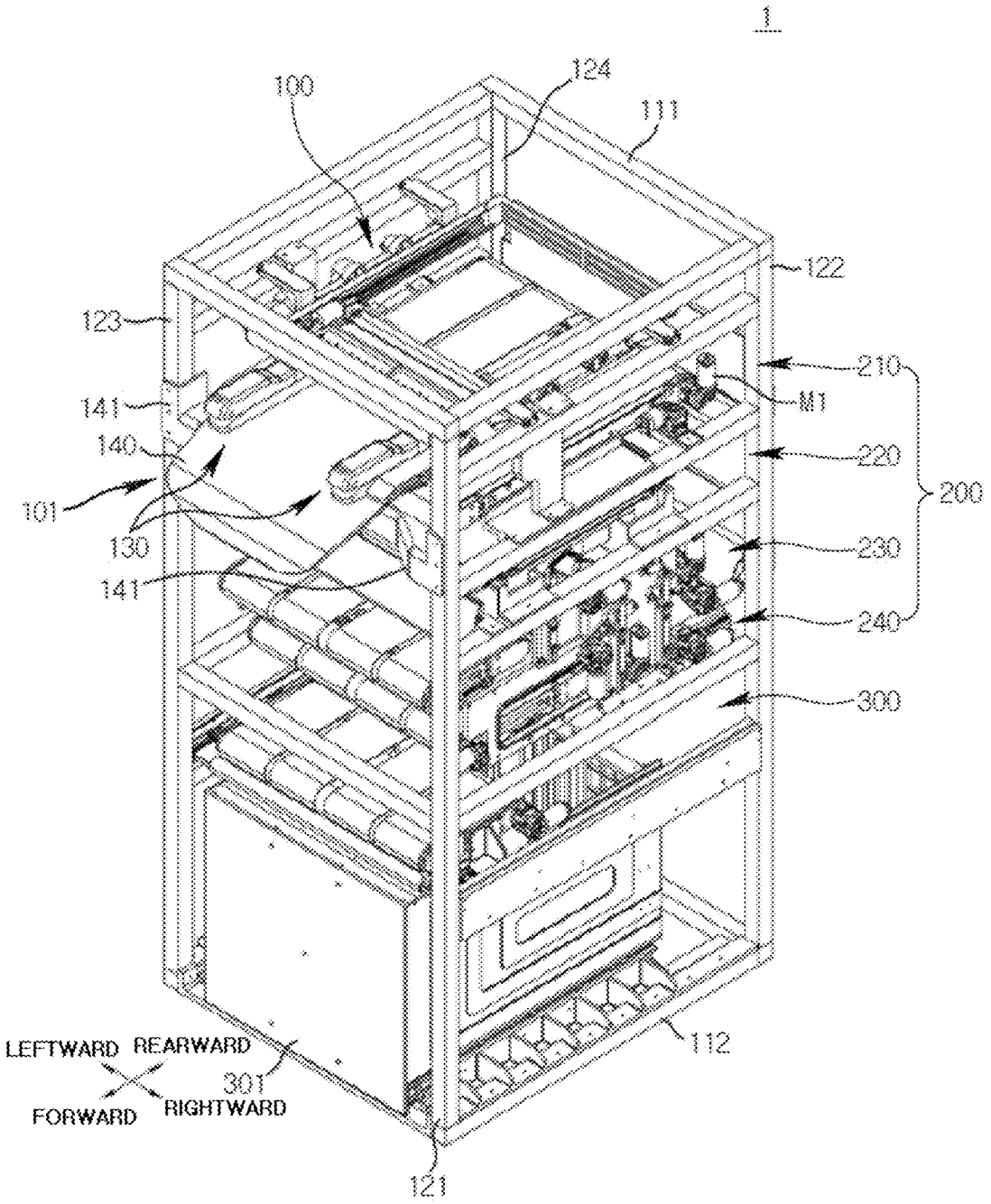
FIG. 1 is a schematic configuration view illustrating a basic configuration of a garment folding machine according to the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various components, but the components should not be limited by the terms. These terms are used only to distinguish one component from another component. For example, a first component may be named a second component, and similarly, the second component may also be named the first component, without departing from the scope of the present disclosure.

The term "and/or" may include any and all combinations of a plurality of the related and listed items.

When one component is described as being "coupled" or "connected" to another component, it should be understood that one component can be coupled or connected directly to another component, and an intervening component can also be present between the components. When one component is described as being "coupled directly to" or "connected directly to" another component, it should be understood that no intervening component is present between the components.

The terms used herein is used for the purpose of describing particular embodiments only and is not intended to limit the present disclosure. Singular expressions may include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

Hereinafter, a garment folding machine 1 according to the present disclosure will be described with reference to FIGS. 1 to 3.

Figure 2:
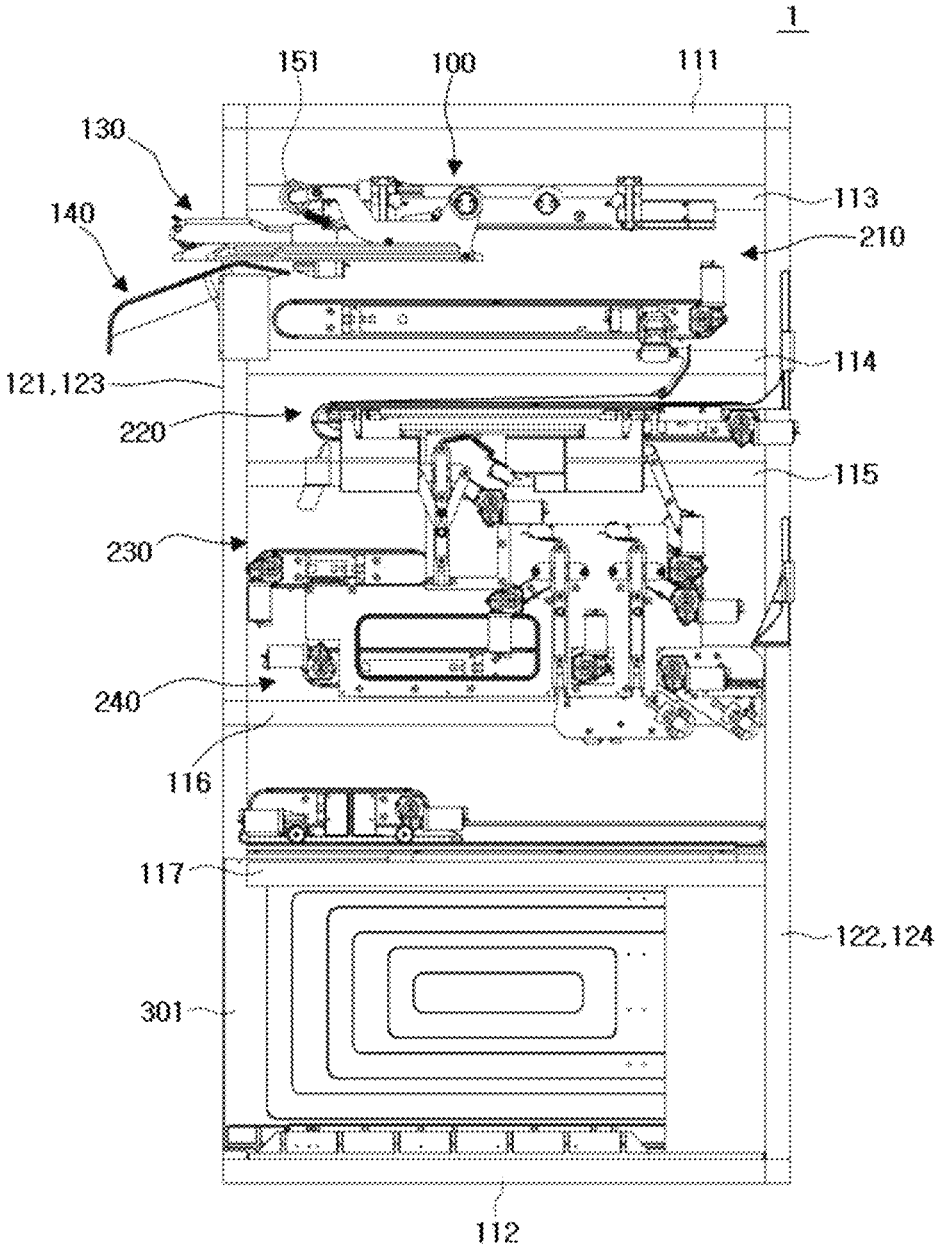
FIG. 2 is a side view of FIG. 1, that is, a schematic view illustrating a plurality of folding layers disposed as a layered structure.
Figure 3:
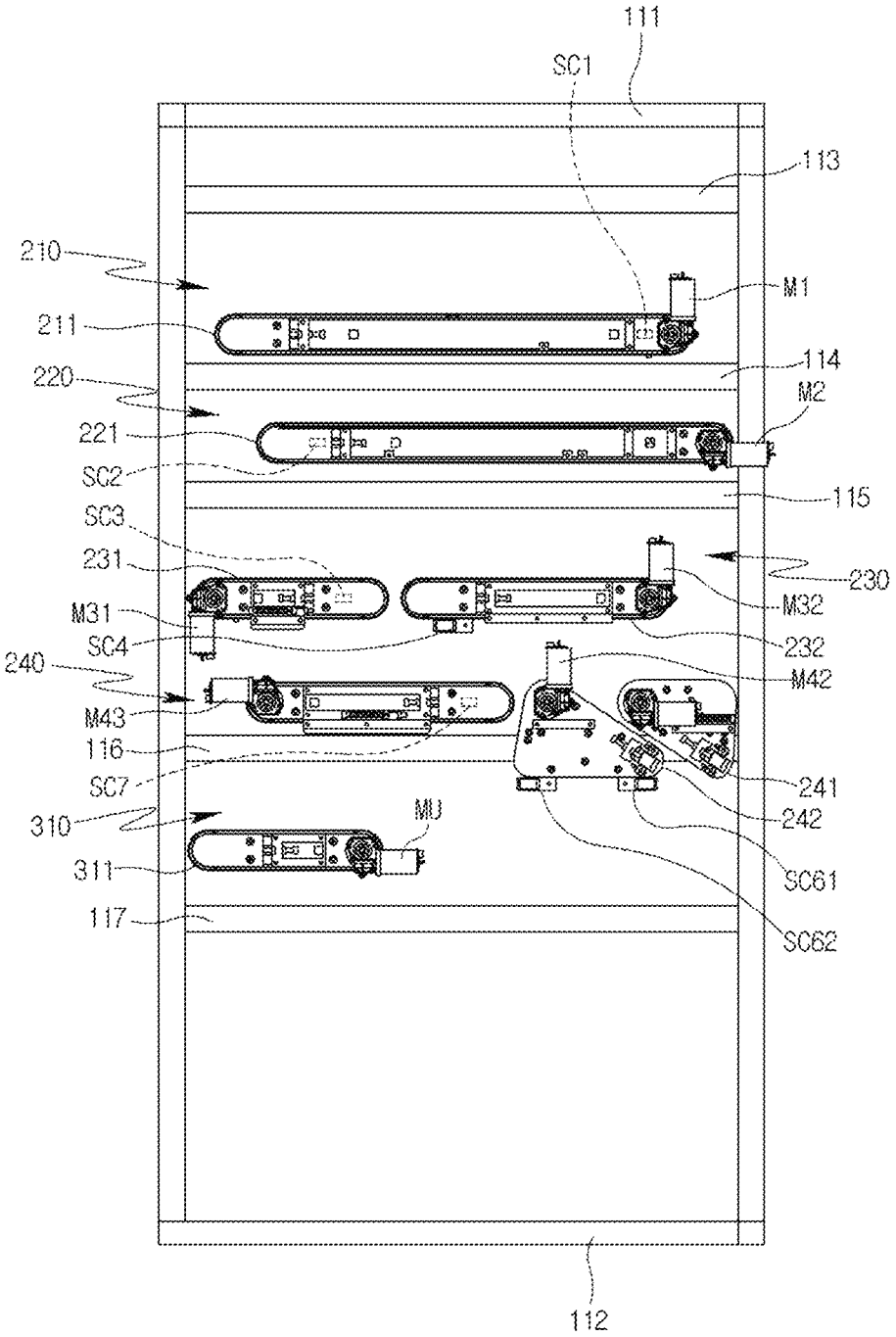
FIG. 3 is a schematic view illustrating conveyor structures of individual folding layers in the configuration illustrated in FIG. 2.

Referring to FIGS. 1 to 3, the garment folding machine 1 according to the present disclosure includes a frame unit 110 that serves as an external framework.

The frame unit 110 is disposed at an outer edge of the garment folding machine 1 and defines a minimum operating space in the garment folding machine 1. The frame unit 110 may stably support several members constituting the garment folding machine 1.

In more detail, the frame unit 110 includes an upper frame 111, a lower frame 112, a plurality of horizontal frames 113, 114, 115, 116, and 117, and a plurality of vertical frames 121, 122, 123, and 124.

The upper frame 111 is horizontally disposed at an upper end of the garment folding machine 1, and an upper operating space of the garment folding machine 1 may be defined by the upper frame 111.

The lower frame 112 may be horizontally disposed at a lower end of the garment folding machine 1 and may support the garment folding machine 1 on a floor. A lower operating space of the garment folding machine 1 may be defined by the lower frame 112.

The plurality of horizontal frames 113, 114, 115, 116, and 117 may be horizontally disposed between the upper frame 111 and the lower frame 112. A loading unit 100, a folding unit 200, and an unloading unit 300, which will be described below, may be mounted and supported on the plurality of horizontal frames 113, 114, 115, 116, and 117.

A space between the two horizontal frames may be defined as an operating space for an individual folding layer.

For example, an operating space for a second folding layer 220 (see FIGS. 2 and 3) for performing vertical folding may be defined by a second horizontal frame 114 and a third horizontal frame 115.

Meanwhile, the space between the two horizontal frames may also be defined as an operating space for the two folding layers.

For example, an operating space for the third folding layer 230 and the fourth folding layer 240 (see FIGS. 2 and 3) for performing horizontal folding may be defined by the third horizontal frame 115 and a fourth horizontal frame 116.

In addition, a first horizontal frame 113 disposed adjacent to the upper frame 111 may be provided to support a clip assembly 130 for holding and conveying a garment inputted into a loading part 101. A fifth horizontal frame 117 disposed adjacent to the lower frame 112 may be provided below a guide rail to support the guide rail that serves to allow an unloading conveyor 311 to be described below to slide in a forward/rearward direction.

Meanwhile, the vertical frames 121, 122, 123, and 124 include first and third vertical frames 121 and 123 disposed at a front side from which the garment is inputted, and second and fourth vertical frames 122 and 124 disposed to face the first and third vertical frames 121 and 123 and configured to define a rear operating space in the garment folding machine 1.

A finishing cover (not illustrated) may be stably attached to an outer peripheral side of the frame unit 110, and the finishing cover serves to define an external appearance of the garment folding machine 1 and protect the members disposed in the garment folding machine 1. In addition, an input unit (not illustrated), a display unit 600 (see FIG. 16), and an alarm unit 700 (see FIG. 16) may be provided on a front portion of the finishing cover, the input unit (not illustrated) is configured to receive a control instruction from a user, the display unit 600 is configured to visually provide the user with information on operating states of the garment folding machine 1, and the alarm unit 700 is configured to aurally provide the user with information on the operating states of the garment folding machine 1.

Since the frame unit 110 is provided as described above, a vertical folding assembly 222 and horizontal folding assemblies 233, 244, and 245 are supported at the same time so that the functions of conveying and folding the garment are smoothly performed by respective folding layers 210, 220, 230, and 240 of the folding unit 200 to be described below, such that a required space may be saved and an overall volume of the garment folding machine 1 may be reduced.

Meanwhile, the garment folding machine 1 may include the loading unit 100, the folding unit 200, and the unloading unit 300.

The loading unit 100, the folding unit 200, and the unloading unit 300 may be supported on the frame unit 110, and an operating space for the loading unit 100, an operating space for the folding unit 200, and an operating space for the unloading unit 300 may be defined by the frame unit 110.

For example, the operating space of the loading unit 100 may be defined by the upper frame 111 and the second horizontal frame 114, and the operating space of the unloading unit 300 may be defined by the fourth horizontal frame 116 and the lower frame 112.

The loading unit 100 serves to load the garment. The loading unit 100 serves to load the garment, which is inputted to the loading part 101, at a predetermined position on an upper surface of a first conveyor 211 of the first folding layer 210.

In this case, the garments not only mean upper garments or lower garments manufactured using natural fibers or synthetic fibers so as to be worn by persons, but also include all products such as towels or bedclothes that may be provided by being folded to have desired sizes and thicknesses by the garment folding machine 1.

As an example, the loading unit 100 includes the clip assembly 130 (see FIGS. 1 and 2) that holds the garment inputted by the loading part 101.

FIGS. 1 and 2 illustrate the clip assembly 130 configured to hold the garment at two points. For convenience, the clip assembly 130 configured to hold the garment at the two points will be described, but the present disclosure is not limited thereto.

When the garment is completely held at a first position P1 corresponding to an initial position, the clip assembly 130 draws the garment into the garment folding machine 1 and moves the garment to a second position P2 corresponding to a loading position on the upper surface of the first conveyor 211 while holding the garment and moving rearward by a predetermined distance. When the clip assembly 130 completely moves to the second position P2, the clip assembly 130 releases the garment.

In addition, after the clip assembly 130 releases the garment, the clip assembly 130 additionally moves to a third position P3, that is, a position disposed further rearward from the second position P2. When the clip assembly 130 reaches the third position P3, the first conveyor 211 of the first folding layer 210 begins to operate.

The loading unit 100 includes a loading unit motor ML configured to generate power for moving the clip assembly 130 in the forward/rearward direction. As an example, the loading unit motor ML has a pinion gear fixed to the clip assembly 130 and connected to an output shaft of the loading unit motor ML, and the pinion gear engages with a rectilinear gear fixed to a frame 104 of the loading unit 100, such that rotational power of the loading unit motor ML may be converted into a force for rectilinear motion in the forward/rearward direction.

Meanwhile, clip position detection sensors SL for specifying the first to third positions P1, P2, and P3 are provided on the frame 104 of the loading unit 100. In more detail, the clip position detection sensors SL include an initial position detection sensor SL1 configured to detect whether the clip assembly 130 is positioned at the first position P1, a clip open position detection sensor SL2 configured to detect whether the clip assembly 130 is positioned at the second position P2, and a stop position detection sensor SL3 configured to detect whether the clip assembly 130 is positioned at the third position P3.

The detailed configuration in relation to the operation of the first conveyor 211 related to the movement of the clip assembly 130 will be described below with reference to FIGS. 4A to 4C.

The folding unit 200 serves to convey and fold the garment loaded by the loading unit 100.

In more detail, as illustrated in FIGS. 2 and 3, the folding unit 200 includes the four or more folding layers 210, 220, 230, and 240 so that the loaded garment is conveyed and folded to an appropriate size and shape. The four or more folding layers 210, 220, 230, and 240 are disposed to be spaced apart from one another in the upward/downward direction.

The loaded garment is folded one or more times while being conveyed from the folding layer at the upper side to the folding layer at the lower side, and the garments, which are completely folded to appropriate sizes and shapes, are collected in a discharge unit 301.

In the embodiment illustrated in FIG. 3, the folding unit 200 may include the four folding layers 210, 220, 230, and 240.

The four folding layers 210, 220, 230, and 240 are disposed to be spaced apart from one another in the upward/downward direction and serve to allow the loaded garment to be folded to an appropriate size and shape while being conveyed from the first folding layer 210 at the uppermost side to the fourth folding layer 240 at the lowermost side.

An unloading layer 310 may be disposed below the fourth folding layer 240 at the lowermost side. In the embodiment illustrated in FIG. 3, the unloading layer 310 may be further provided below the fourth folding layer 240, and the completely folded garment is dropped onto the unloading layer 310. As described above, the unloading layer 310 is provided with the discharge unit 301 such that the completely folded garments are uniformly collected.

Each of the folding layers 210, 220, 230, and 240 includes at least one conveyor 211, 221, 231, 241, 242, or 243. The conveyors 211, 221, 231, 241, 242, and 243 serve to convey or horizontally fold the loaded garment.

In more detail, in the embodiment illustrated in FIGS. 2 and 3, the first folding layer 210 includes a first conveyor 211 and a first conveyor motor M1 configured to operate the first conveyor 211.

In addition, the second folding layer 220 includes a second conveyor 221 and a second conveyor motor M21 configured to provide driving power for operating the second conveyor 221.

Meanwhile, the third folding layer 230 may include a third conveyor 231 and a fourth conveyor 232 spaced apart from each other at a predetermined interval, and a third conveyor motor M31 and a fourth conveyor motor M32 configured to provide driving power for operating the third conveyor 231 and the fourth conveyor 232, respectively.

As illustrated, the third conveyor 231 is disposed at the front side of the garment folding machine 1, the fourth conveyor 232 is disposed at the rear side of the garment folding machine 1, and an upper surface of the third conveyor 231 and an upper surface of the fourth conveyor are disposed approximately side by side.

Meanwhile, the predetermined interval defined between the third conveyor 231 and the fourth conveyor 232 of the third folding layer 230 is a first folding gap G1 that serves to allow the garment to pass through the first folding gap G1 while being horizontally folded.

The fourth folding layer 240 may be disposed below the third folding layer 230 and provided to perform horizontal folding on the garment C.

In this case, the fourth folding layer 240 may have a fifth conveyor 241, a sixth conveyor 242, and a seventh conveyor 243 disposed sequentially from the rear side to the front side of the garment folding machine 1. A fifth conveyor motor M41, a sixth conveyor motor M42, and a seventh conveyor motor M43 configured to provide driving power for operating the fifth conveyor 241, the sixth conveyor 242, and the seventh conveyor 243.

Two folding gaps G2 and G3 may be defined between the fifth conveyor 241, the sixth conveyor 242, and the seventh conveyor 243 provided in the fourth folding layer 240 so that the garment may be horizontally folded or may pass through the two folding gaps G2 and G1 while being horizontally folded.

In this case, the horizontal folding means that the garment is folded about a reference line perpendicular to a proceeding direction of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

Meanwhile, the folding unit 200 is configured to perform the vertical folding function that serves to vertically fold the loaded garment.

In the embodiment illustrated in FIG. 3, the first folding layer 210 and the second folding layer 220, which are the two upper folding layers among the four folding layers constituting the folding unit 200, are configured to vertically fold the garment.

In this case, the vertical folding means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

First, the first folding layer 210 may serve to vertically fold the garment loaded from the loading unit 100 while conveying the garment to a rear end thereof. In particular, the first folding layer 210 may vertically fold a sleeve portion of an upper garment that needs to be vertically folded.

Specifically, in a state in which the sleeve portion of the upper garment is folded to a predetermined degree by a seating plate 140 (see FIG. 1) provided in the loading part 101 of the loading unit 100 and by a primary vertical folding guide 141 provided at a lower side of the seating plate 140, the garment may be loaded onto the first conveyor 211 while being pulled by the clip assembly 130 and vertically folded primarily and manually.

As described above, the loading by the loading unit 100 and the vertical folding are performed at the same time in the first folding layer 210, such that the folding process may be simplified and the size of the machine may be reduced.

The second folding layer 220 may be disposed below the first folding layer 220 and provided to perform vertical folding on the garment.

Meanwhile, the second folding layer 220 may be provided with a vertical folding assembly 222 in order to vertically fold the garment C conveyed from the first folding layer 210.

The vertical folding assembly 222 may be configured as an active assembly having a mechanism that actively and vertically folds the garment C by receiving a force from a vertical folding motor M22 (see FIG. 6) which is a driving source.

As an example, the vertical folding assembly 222 may include vertical folding plates 2221 (see FIG. 6) configured such that a position thereof is changed by the force from the vertical folding motor M22.

The pair of vertical folding plates 2221 having approximately the same shape may be provided, and the second conveyor 221 is disposed between the pair of vertical folding plates 2221.

The vertical folding plates 2221 are on standby on the same plane as an upper surface of the second conveyor at the initial position. In order to vertically fold the garment delivered from the first conveyor 211 and deployed on the second conveyor 221 and the vertical folding plates 2221, the pair of vertical folding plates 2221 lifts up two opposite portions of the garment and moving the two opposite portions of the garment toward the inside of the garment, thereby vertically folding the garment.

The vertical folding assembly 222 may further include plate position sensors (not illustrated) capable of detecting an initial position and a vertical folding completion position of the vertical folding plates 2221.

As an example, the vertical folding assembly 222 including the pair of vertical folding plates 2221 to perform the active vertical folding will be described below, but the present disclosure is not limited thereto.

The unloading unit 300 is provided to collect and discharge the folded garment.

The unloading unit 300 is configured such that the completely folded garment is conveyed from the unloading layer 310 (see FIG. 3) by the unloading conveyor 311 and collected in the discharge unit 301. Specifically, the unloading unit 300 may be configured such that the completely folded garment is conveyed by the unloading conveyor 311 and collected in the discharge unit 301 between the horizontal frame 116 and the lower frame 112.

As an embodiment, the garment dropped by the folding assembly is placed on the unloading conveyor 311. Thereafter, the unloading conveyor 311 moves in the forward/rearward direction, and at the same time, an unloading plate (not illustrated) moves in the upward/downward direction, such that the completely folded garments are uniformly collected in an internal space of the discharge unit 301.

Meanwhile, as described above, the object of the present disclosure is to provide a means capable of accurately detecting and determining the lumping of the garment C during the process of conveying or folding the garment C.

Hereinafter, a process of detecting and determining the lumping of the garment C, which may occur during the process of conveying or folding the garment C in the respective folding layers of the loading unit 100 and the folding unit 200, will be described.

Figure 4A:
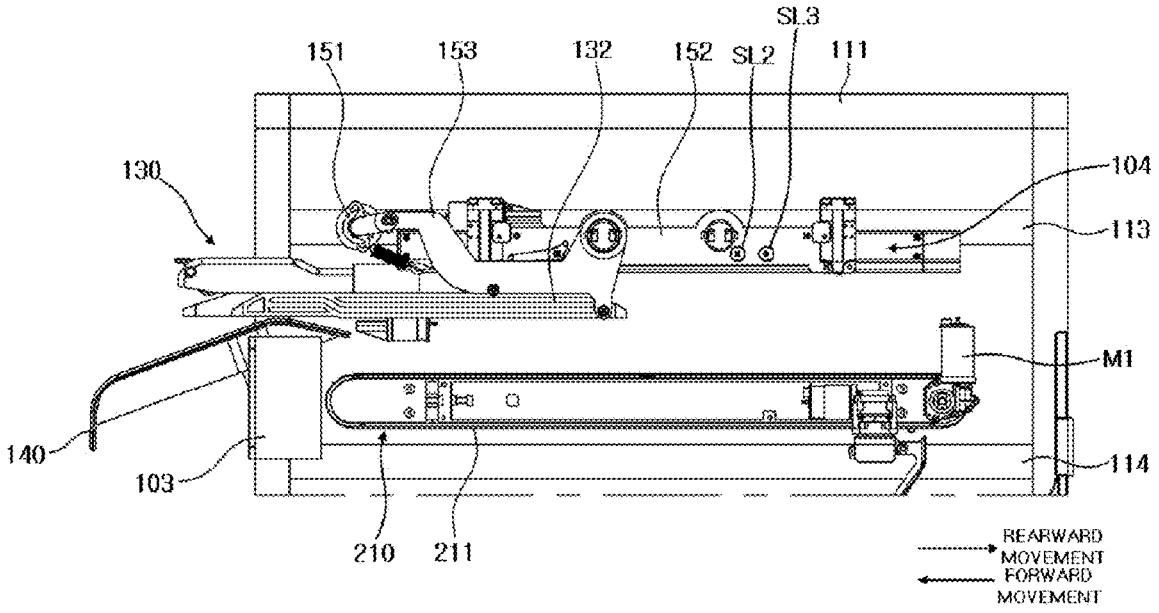
FIGS. 4A to 4C are partial enlarged views for explaining an operation of a loading unit among the components illustrated in FIG. 2.
Figure 4B:
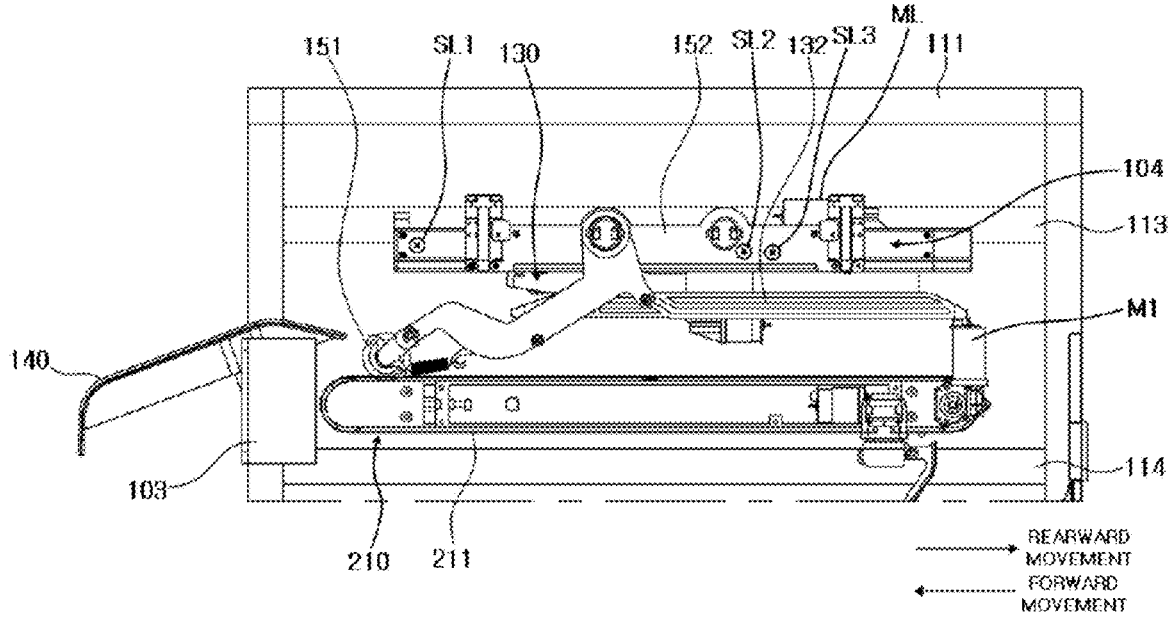
Figure 4C:
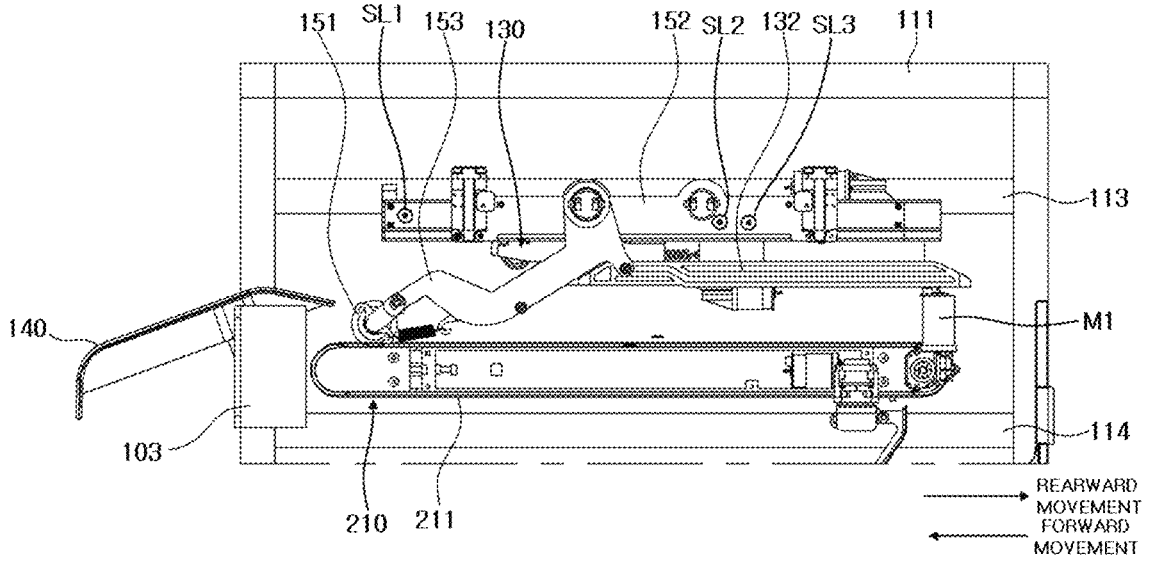
Figure 6:
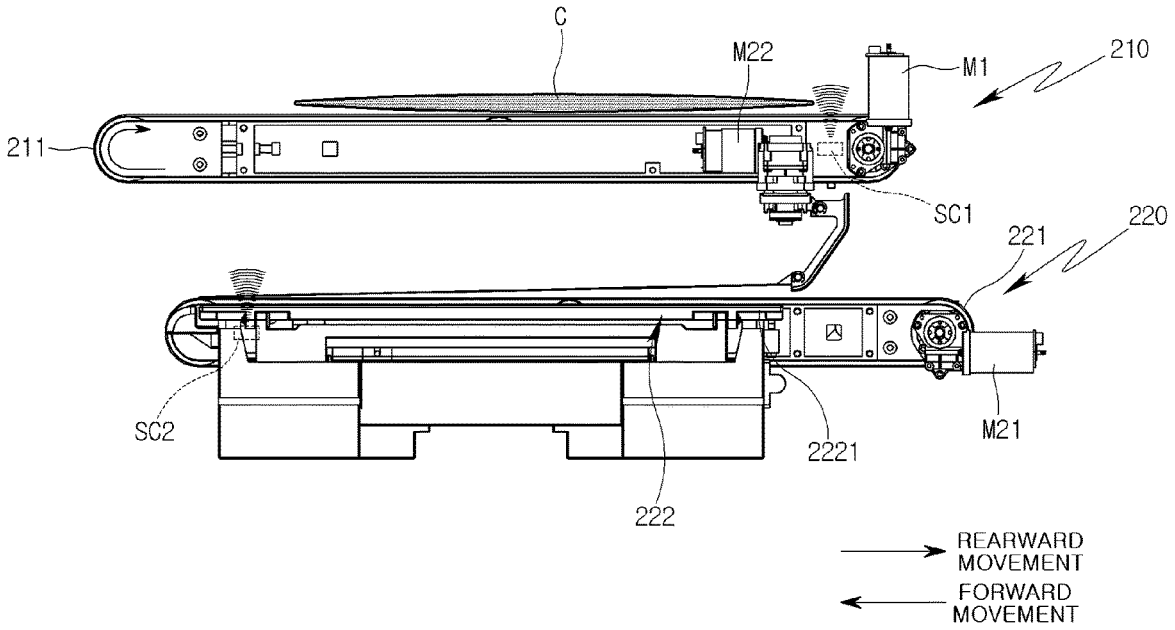
FIGS. 6 to 8 are schematic views for explaining a process of conveying a garment from the first folding layer to a second folding layer after the garment is completely loaded by the loading unit.

FIGS. 4A to 4C are partially enlarged views for explaining of an operation of the loading unit 100 among the components illustrated in FIG. 2, and FIG. 6 is a schematic view for explaining a process of conveying the garment C by the first conveyor 211 in the first folding layer 210 after the garment C is completely loaded by the loading unit 100.

First, referring to FIGS. 4A to 4C, in a preparation procedure for loading the garment C through the loading part 101, the garment C is held by a clip part 131 of the clip assembly 130 which is on standby at a first stop position.

A holding force of the clip part 131 may be generated by a non-illustrated electromagnetic driving member. Any means well known in the art, such as an electric motor or a solenoid, may be applied as the electromagnetic driving member.

The clip part 131 may be provided with a clip part sensor (not illustrated) that automatically detects whether the garment C, which is an object to be held, reaches a holding position in the clip part 131. Therefore, when the clip part sensor detects that the garment C has reached the holding position, the electromagnetic driving member operates, and the clip part 131 is closed, such that the garment C may be automatically held.

Meanwhile, as another method, a user may operate the electromagnetic driving member by loading the garment C to the holding position in the clip part 131 and then manipulating an input means such as an operation start button, or a touch screen.

When the process of holding the garment C is completed by closing the clip part 131 with the above-mentioned various methods, the operation of the loading unit motor ML is initiated, and the clip assembly 130 is moved to a second stop position disposed rearward from the first stop position and then stopped.

In the illustrated embodiment, the loading unit motor ML is configured to be moved together with the clip assembly 130. That is, the loading unit motor ML is connected to a retraction member 132 of the clip assembly 130, and a pinion gear (not illustrated) is provided on an output shaft of the loading unit motor ML.

In addition, a rack gear (not illustrated) is mounted on a rail frame 152 fixed to the first horizontal frame 113, and the pinion gear meshes with the rack gear. Therefore, when the operation is initiated as the current is supplied to the unloading motor, the pinion gear rotates, such that the loading unit motor ML and the retraction member 132 rectilinearly move in a longitudinal direction of the rack gear.

However, the above-mentioned method of converting the motion using the pinion gear and the rack gear is provided for illustration only, and any means may be applied without limitation as long as this means may convert the rotational motion of the loading unit motor ML into the rectilinear reciprocating motions of the retraction member 132 and the clip part 131. Hereinafter, the motion conversion method using the pinion gear and the rack gear will be described below, for example.

Meanwhile, FIG. 4B illustrates a state in which the clip assembly 130 has reached the second stop position. The second stop position is a position at which the clip part 131 is opened and the garment C is released. A clip open position detection sensor is provided on the rail frame 152 and detects whether the retraction member 132 and the clip part 131 have reached the second stop position.

When the clip open position detection sensor detects that the retraction member 132 and the clip part 131 have reached the second stop position, the supply of current to the loading unit motor ML is cut off, and the clip part 131 is opened, such that the garment moved by the clip part 131 is seated at the loading position on the first conveyor 211.

As illustrated in FIG. 4B, a conveying roller 151, which is provided as a means for supporting the garment C at the loading position, is moved downward while being rotated counterclockwise by a roller link 153 at the same time when the retraction member 132 and the clip part 131 reach the second stop position and the clip part 131 is opened.

When the clip part 131 reaches the second stop position and the clip part 131 is opened, the garment C having a relatively long length has a portion that does not pass through the loading part 101, and the garment C deviates from the loading position by a weight of the garment C that does not pass through the loading part 101.

Therefore, the conveying roller 151 presses the garment C against the upper surface of the first conveyor 211 at the same time when the clip part 131 is opened, and as a result, it is possible to effectively prevent the garment C from deviating from the loading position.

Meanwhile, in a case in which the garment C being conveyed as described above is an object, such as an upper garment, to be subjected to the primary vertical folding, the primary vertical folding may be performed, at the same time when the garment C is moved by the clip part 131, by the operations of the seating plate 140 and the primary vertical folding guide unit 141.

Meanwhile, after the clip part 131 is opened, the current is supplied to the loading unit motor ML, such that the clip part 131 and the retraction member 132 are additionally retracted to a third stop position.

Like the clip open position detection sensor, a rear end position detection sensor SL3 is provided on the rail frame 152 and detects whether the retraction member 132 and the clip part 131 have reached the third stop position.

When the rear end position detection sensor SL3 detects that the retraction member 132 and the clip part 131 have reached the third stop position, the loading unit motor ML is stopped, and at the same time, and the current is supplied to the first conveyor motor M1, such that the operation of the first conveyor 211 is initiated.

Meanwhile, after it is determined that the garment C is completely conveyed from the first conveyor 211 to the second conveyor 221, the loading unit motor ML is controlled so that the retraction member 132 and the clip part 131 are moved to the first stop position so as not to interfere with the conveyance of the garment C by the first conveyor 211.

The initial position detection sensor SL1 is provided on the rail frame 152 and detects whether the retraction member 132 and the clip part 131 are returned to the first stop position.

The same type of sensor may be applied to the initial position detection sensor SL1, the clip open position detection sensor, and the rear end position detection sensor SL3. In particular, the sensor may be a Hall sensor that detects a change in magnetic field generated during the process of moving the retraction member 132 and the clip part 131. However, the present disclosure is not limited thereto, and any means well known in the art may be applied without limitation as long as this means may detect the position of the retraction member 132 or the clip part 131 or detect whether the retraction member 132 or the clip part 131 has reached the position.

As described above, when the retraction member 132 and the clip part 131 reach the third stop position and the first conveyor motor M1 operates rearward, the conveyance of the garment C by the first conveyor 211 is initiated.

Figure 5:
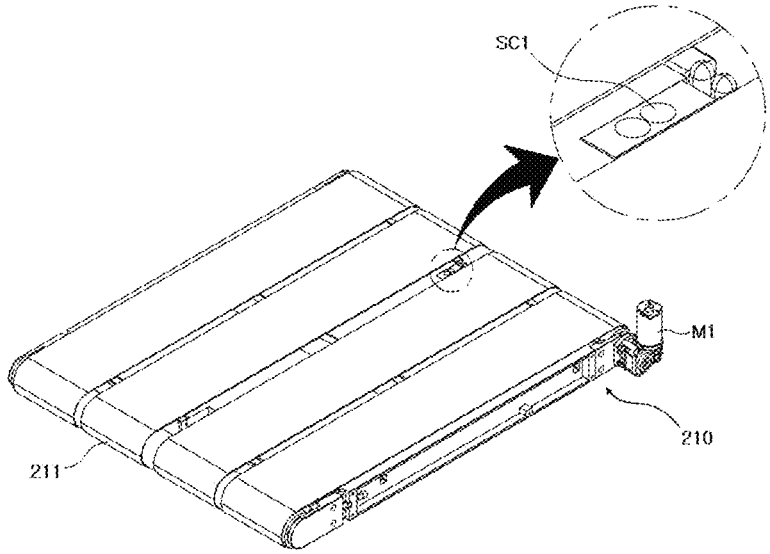
FIG. 5 is a perspective view for explaining a configuration of a garment detection sensor provided in a first folding layer among the components illustrated in FIG. 2.

As illustrated in FIG. 5, the first-conveyor-rear-end garment detection sensor SC1 is provided at the rear end of the first conveyor 211 and detects whether the garment C, which begins to be conveyed, reaches the rear end of the first conveyor 211.

As an example, the first-conveyor-rear-end garment detection sensor SC1 is disposed in the first conveyor 211 and configured to detect whether the garment C reaches the first conveyor or whether the garment C passes through the first conveyor through a gap between a plurality of first conveyor belts which are separated from one another.

The first-conveyor-rear-end garment detection sensor SC1 serves only to detect whether the garment C is present in an effective detection range. The first-conveyor-rear-end garment detection sensor SC1 is a digital sensor that outputs an ON-signal when the garment C is present in the effective detection range, and outputs an OFF-signal when the garment C is not present in the effective detection range. In the embodiment according to the present disclosure, a contactless IR (infrared ray) sensor may be applied, for example, but the present disclosure is not limited thereto.

Garment detection sensors, which perform the same function in the same way as the first-conveyor-rear-end garment detection sensor SC1, are provided at a front end of the second conveyor 221, a rear end of the third conveyor 231, a lower side of the fourth conveyor 232, a rear end of the seventh conveyor 243, a rear lower side and a front lower side of the sixth conveyor 242, and a front end of the fifth conveyor 241, respectively.

Hereinafter, for convenience, the embodiment in which the IR sensor is applied as the garment detection sensor will be described.

FIG. 6 illustrates a state in which the first conveyor motor M1 operates rearward and the first conveyor 211 conveys the garment C.

As illustrated in FIG. 6, when the garment C is conveyed by the movement of the first conveyor 211, a first-conveyor-rear-end garment detection sensor SC1 detects whether a tip of the garment C reaches a rear end of the first conveyor 211.

When the first-conveyor-rear-end garment detection sensor SC1 detects that the tip of the garment C has reached the rear end of the first conveyor 211, the second conveyor motor M21 operates forward at the same time to deliver the garment C to the second folding layer 220.

In this case, in order to prevent the garment C being delivered from being wrinkled due to a difference in linear velocity between the second conveyor 221 and the first conveyor 211, the linear velocity of the second conveyor 221 and the linear velocity of the first conveyor 211 may be maintained to be almost equal.

However, in a case in which the tip of the garment C does not reach the rear end of the first conveyor, that is, in a case in which the tip of the garment C does not reach the rear end of the first conveyor 211 or a motor current value supplied to the first conveyor motor M1 is excessively high (the first conveyor motor M1 is overloaded) even though a predetermined delay time elapses after the rearward operation of the first conveyor motor M1 is initiated, it may be determined by the first-conveyor-rear-end garment detection sensor SC1 that the lumping of the garment C has occurred.

In more detail, it may be determined that the lumping of the garment C has occurred in the first folding layer 210 when a first delay time T1 is equal to or larger than a predetermined first critical delay time Tth1 or a first motor current value A1 supplied to the first conveyor motor M1 is equal to or larger than a predetermined first critical motor current value Ath1 after the rearward operation of the first conveyor motor M1 is initiated in a state in which it is determined, based on the output signal from the first-conveyor-rear-end garment detection sensor SC1, that the tip of the garment C does not reach the rear end of the first conveyor 211 which is a target position.

As described above, when it is determined that the lumping of the garment C has occurred in the first folding layer 210, the supply of power to the first conveyor motor M1 is cut off to prevent an overload of the first conveyor motor M1 and prevent damage to the garment C and the components.

In this case, the first critical delay time Tth1 is a numerical value that may be adjusted depending on a size of the first conveyor 211, a linear velocity of the conveyor, and a size of the garment C which is an object to be conveyed. For example, because a maximum length of the garment C applicable to the garment folding machine 1 according to the present disclosure is about 3 m, the first critical delay time Tth1 may be set to about 10 seconds when the linear velocity of the first conveyor 211 is 30 cm/s.

In addition, the first critical motor current value Ath1 may vary depending on the output of the first conveyor motor M1 and may be set to about 2 A, for example.

Meanwhile, when it is determined that the lumping of the garment C has occurred in the first folding layer 210 as described above, an alarm including first error information indicating that the lumping of the garment C has occurred in the first folding layer 210 is generated and transferred to the user through the display unit and the alarm unit.

Therefore, the user may accurately recognize a portion where the lumping of the garment C has occurred, and the user may take an immediate action for eliminating the garment lumping.

Figure 7:
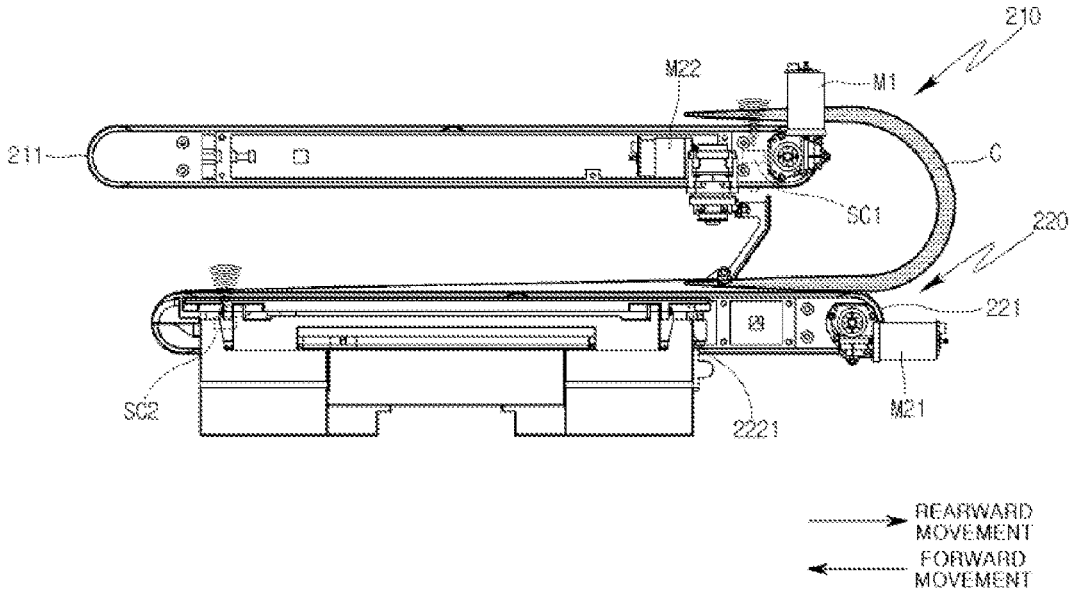
Figure 8:
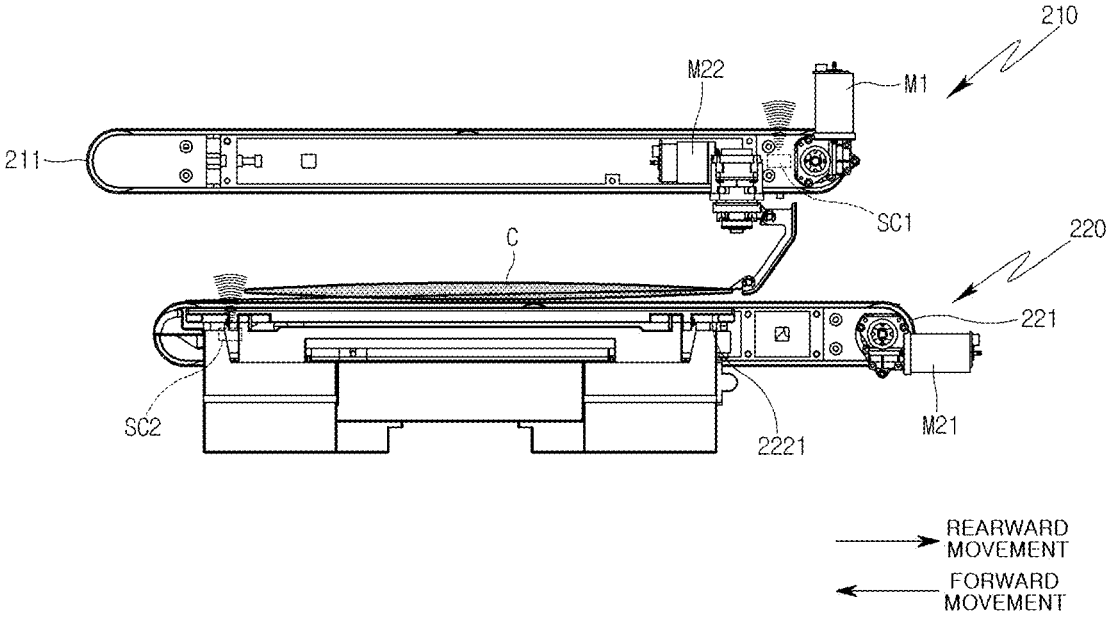

FIGS. 7 and 8 illustrate the process of delivering the garment C from the rear end of the first conveyor 211 to the rear end of the second conveyor 221 when it is determined that the tip of the garment C has reached the first-conveyor-rear-end garment detection sensor SC1.

The garment lumping determination criterion applied to the first folding layer 210 may also be similarly applied to the second conveyor 221 in the second folding layer 220.

As described above, when the first-conveyor-rear-end garment detection sensor SC1 detects that the garment C has successfully reached the rear end of the first conveyor 211, the forward operation of the second conveyor motor M21 is initiated, such that the second conveyor 221 operates in a direction in which the garment C is moved forward.

That is, the second conveyor 221 may convey the garment C, which has passed through the first folding layer 210, from the rear end to the front end thereof.

In this case, a front end of the second conveyor 221 is a target position at which whether the garment C is successfully conveyed from the first conveyor 211 to the second conveyor 221 is determined. To this end, the second conveyor 221 is provided with a second-conveyor-front-end garment detection sensor SC2 that detects whether the tip of the garment C has reached the corresponding target position.

Like the first-conveyor-rear-end garment detection sensor SC1, the second-conveyor-front-end garment detection sensor SC2 is an IR sensor.

That is, the second-conveyor-front-end garment detection sensor SC2 may be disposed at the front end of the second conveyor 221, may detect whether the garment C is present at a target position, and may generate a detection signal.

The second-conveyor-front-end garment detection sensor SC2 detects whether the tip of the garment C has reached the front end of the second conveyor in the second folding layer 220. In the case in which whether the garment C reaches the front end of the second conveyor is not detected by the second-conveyor-front-end garment detection sensor SC2, it may be determined that the lumping of the garment C has occurred when the tip of the garment C does not reach the front end of the second conveyor 221 or the motor current value supplied to the second conveyor motor M21 is excessively large even though a predetermined delay time elapses after the forward operation of the second conveyor motor M21 is initiated.

In more detail, it may be determined that the lumping of the garment C has occurred on the second conveyor 221 in the second folding layer 220 when a second delay time T2 is equal to or larger than a predetermined second critical delay time Tth2 or a second motor current value A2 supplied to the second conveyor motor M21 is equal to or larger than a predetermined second critical motor current value Ath2 after the forward operation of the second conveyor motor M21 is initiated in a state in which it is determined, based on the output signal from the second-conveyor-front-end garment detection sensor SC2, that the tip of the garment C does not reach the front end of the second conveyor 221 which is a target position.

As described above, when it is determined that the lumping of the garment C has occurred on the second conveyor 221, the supply of power to the first conveyor motor M1 and the second conveyor motor M21 is cut off to prevent overloads of the first conveyor motor M1 and the second conveyor motor M21 and prevent damage to the garment C and the components.

In this case, like the first critical delay time Tth1, the second critical delay time Tth2 may be set to about 10 seconds because the garment C is not horizontally folded and the length of the garment C is maintained constantly.

In addition, like the first critical motor current value Ath1, the second critical motor current value Ath2 may be set to about 2 A when the second conveyor motor M21 has the same output as the first conveyor motor M1. The second critical motor current value Ath2 may be set to be different from the first critical motor current value Ath1 when the second conveyor motor M21 is a motor having an output different from the output of the first conveyor motor M1.

In addition, when it is determined that the lumping of the garment C has occurred in the second folding layer 220 as described above, an alarm including second error information indicating that the lumping of the garment C has occurred in the second folding layer 220 is generated and transferred to the user through the display unit and the alarm unit.

Meanwhile, when the second-conveyor-front-end garment detection sensor SC2 detects that the garment C has successfully reached the front end of the second conveyor 221, the next process is determined depending on whether the garment C needs to be subjected to the vertical folding.

If the garment C is set in advance as an object such as an upper garment to be subjected to the vertical folding, the second conveyor motor M21 is stopped immediately when the tip of the garment C reaches the front end of the second conveyor 221, and the vertical folding assembly 222 operates to perform the vertical folding on the garment C.

In more detail, first, the current is supplied to the vertical folding motor M22, and the vertical folding motor M22 operates.

The pair of vertical folding plates 2221 is moved, by the operation of the vertical folding motor M22, from the standby position toward a center of the garment C by a movement amount corresponding to a vertical folding width set in advance to the garment C to be vertically folded.

When the vertical folding is completely performed on the garment C by the movement of the vertical folding plate 2221, the vertical folding motor M22 operates in a reverse direction to return the vertical folding plates 2221 to the standby position.

Next, when it is determined that the vertical folding plates 2221 has been returned to the standby position, the second conveyor motor M21 operates forward to convey the garment C to the third folding layer 230, and at the same time, the third conveyor motor M31 of the third folding layer 230 for receiving the garment C operates rearward.

Meanwhile, if the garment C is not set in advance as an object such as an upper garment to be subjected to the vertical folding, the process of vertically folding the garment C is omitted, the second conveyor motor M21 continuously operates forward without being stopped, and the third conveyor motor M31 of the third folding layer 230 for receiving the garment C operates rearward.

Figure 9:
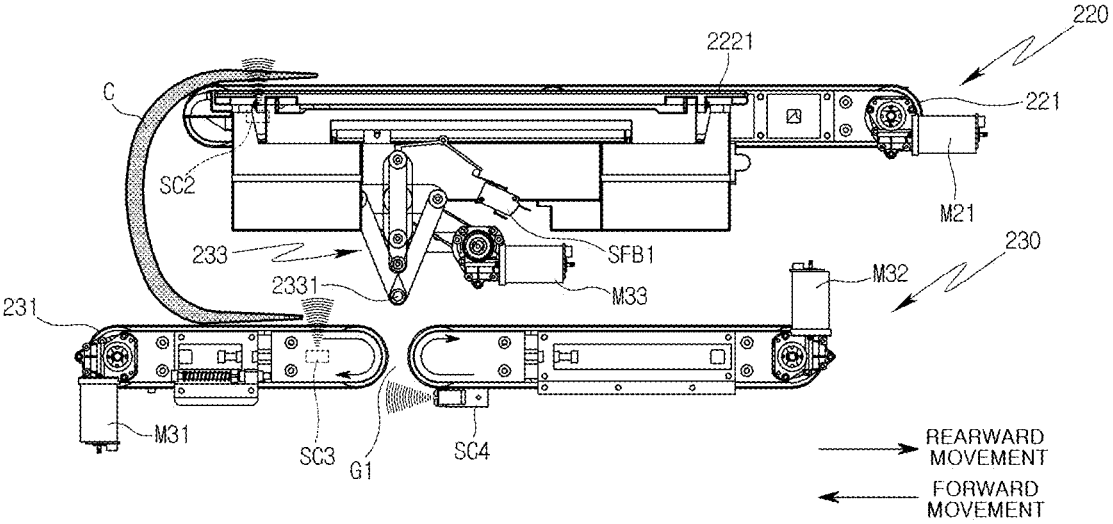
FIGS. 9 to 11 are schematic views for explaining a process of conveying the garment from the second folding layer to a third folding layer and a process of performing horizontal folding in the third folding layer.
Figure 10:
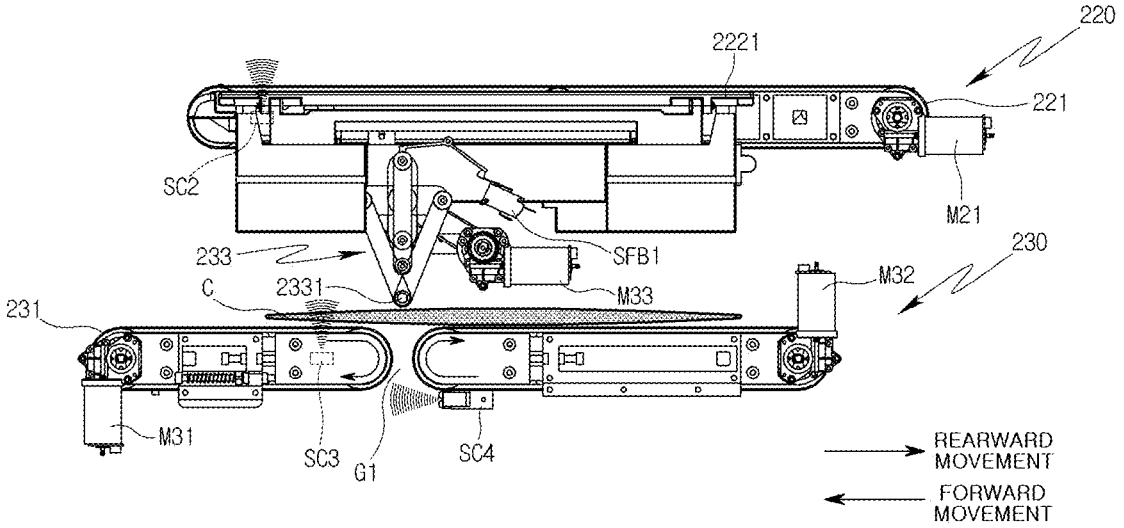
Figure 11:
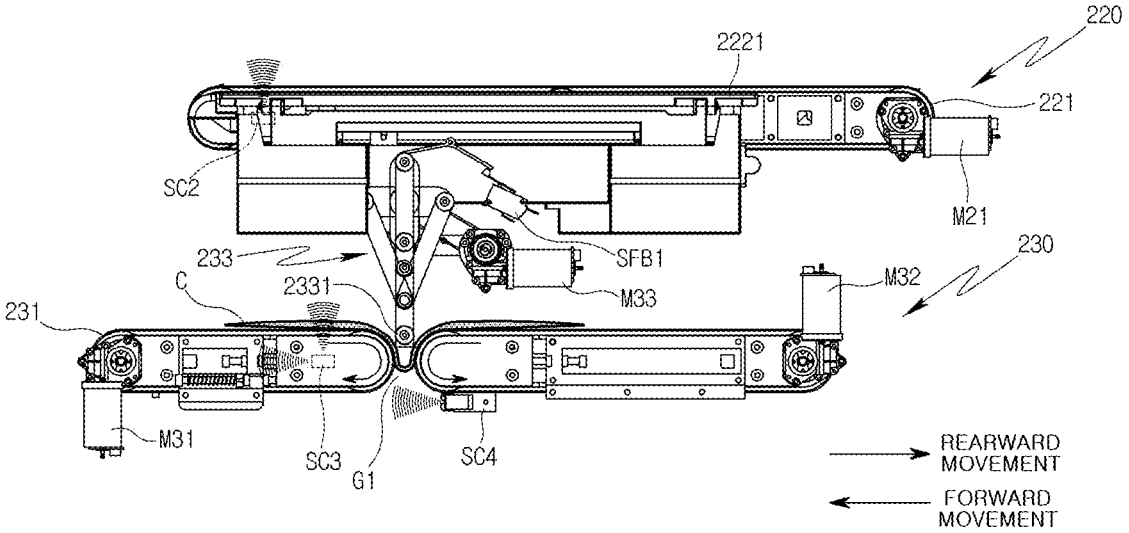
Figure 12:
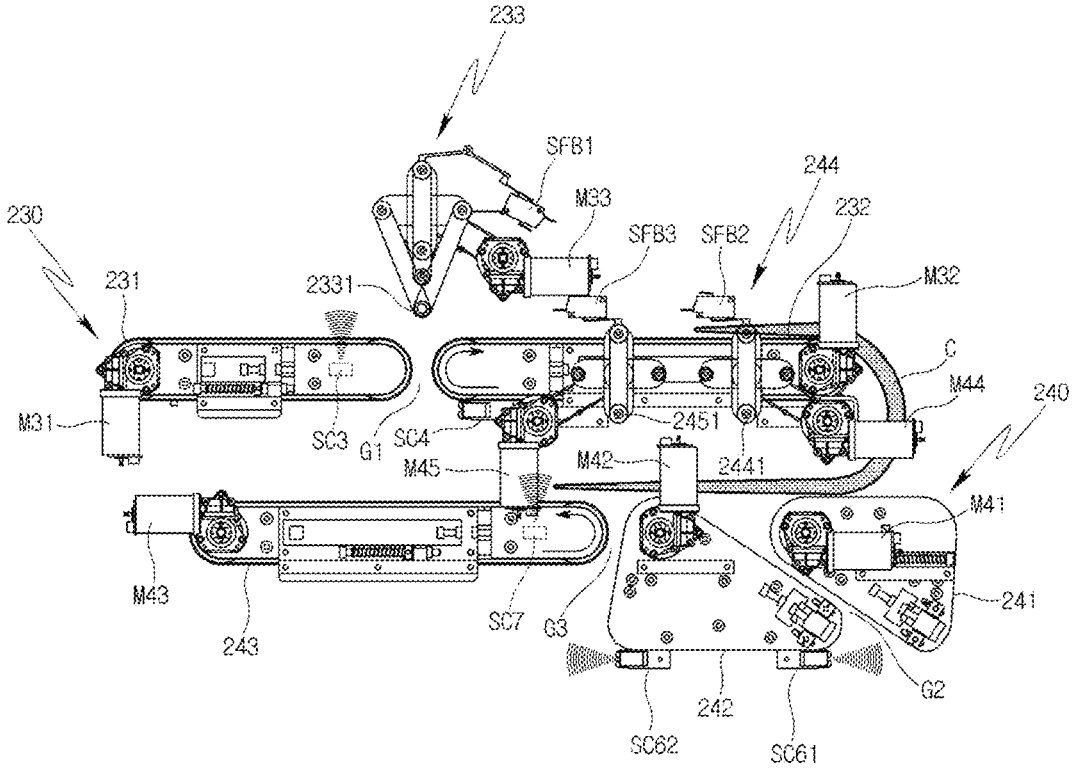
FIGS. 12 to 15 are schematic views for explaining a process of conveying the garment from the third folding layer to a fourth folding layer and a process of performing horizontal folding in the fourth folding layer.

FIGS. 9 to 11 illustrate a process of delivering the garment C from the front end of the second conveyor 221 to the third folding layer 230 and a process of performing ½ horizontal folding on the delivered garment C.

The third folding layer 230 may be disposed below the second folding layer 220 and provided to perform the horizontal folding on the garment C. Therefore, the third conveyor 231 may be provided to convey the garment C, which has passed through the second folding layer 220, to the front end or the rear end thereof.

The garment lumping determination criterion, which is applied to the first folding layer 210 and the second folding layer 220, may also be similarly applied to the process of delivering the garment C to the third folding layer 230 and the ½ horizontal folding process.

A front end of the third conveyor 231 disposed at an upper side of the third folding layer 230 is a target position at which whether the garment C is successfully conveyed from the second conveyor 221 in the second folding layer 220 to the third folding layer 230 is determined.

To this end, a third-conveyor-rear-end garment detection sensor SC3 is provided at the corresponding target position on the third conveyor 231 and detects which the tip of the garment C has reached the target position. Like the above-mentioned garment detection sensors, the third-conveyor-rear-end garment detection sensor SC3 is an IR sensor. That is, the third-conveyor-rear-end garment detection sensor SC3 may be disposed at the rear end of the third conveyor 231, may detect whether the garment C is present at the target position, and may generate a detection signal.

The third-conveyor-rear-end garment detection sensor SC3 detects that the tip of the garment C has reached the rear end of the third conveyor in the third folding layer 230. In the case in which whether the garment C reaches the rear end of the third conveyor is not detected by the third-conveyor-rear-end garment detection sensor SC3, it may be determined that the lumping of the garment C has occurred when the tip of the garment C does not reach the rear end of the third conveyor 231 or the motor current value supplied to the third conveyor motor M31 is excessively large even though a predetermined delay time elapses after the rearward operation of the third conveyor motor M31 is initiated.

In more detail, it may be determined that the lumping of the garment C has occurred on the third conveyor 231 in the third folding layer 230 when a third delay time T3 is equal to or larger than a predetermined third critical delay time Tth3 or a third motor current value A3 supplied to the third conveyor motor M31 is equal to or larger than a predetermined third critical motor current value Ath3 after the rearward operation of the third conveyor motor M31 is initiated in a state in which it is determined, based on the output signal from the third-conveyor-rear-end garment detection sensor SC3, that the tip of the garment C does not reach the rear end of the third conveyor 231 which is a target position.

As described above, when it is determined that the lumping of the garment C has occurred on the third conveyor 231, the supply of power to the third conveyor motor M31 is cut off to prevent an overload of the third conveyor motor M31 and prevent damage to the garment C and the components.

In this case, like the first critical delay time Tth1 and the second critical delay time Tth2, the third critical delay time Tth3 may be set to about 10 seconds because the garment C is not horizontally folded and the length of the garment C is maintained constantly.

In addition, like the first critical motor current value Ath1 and the second critical motor current value Ath2, the third critical motor current value Ath3 may be set to about 2 A when the third conveyor motor M31 has the same output as the first conveyor motor M1 and the second conveyor motor M21. The third critical motor current value Ath3 may be set to be different from the first critical motor current value Ath1 and the second critical motor current value Ath2 when the third conveyor motor M31 is a motor having an output different from the output of the first conveyor motor M1 and the output of the second conveyor motor M21.

In addition, when it is determined that the lumping of the garment C has occurred on the third conveyor 231 in the third folding layer 230 as described above, an alarm including third error information indicating that the lumping of the garment C has occurred in the third conveyor 231 is generated and transferred to the user through the display unit and the alarm unit.

Meanwhile, when the third-conveyor-rear-end garment detection sensor SC3 detects that the garment C has successfully reached the rear end of the third conveyor 231, the next process is determined depending on whether the garment C needs to be subjected to the ½ horizontal folding.

In this case, the fourth conveyor 232 is disposed at a rear side of the third conveyor 231 and provided to convey the garment C forward or rearward so that convey the garment C to the fourth folding layer 240 or perform the horizontal folding on the garment C.

If the garment C is not set in advance as an object to be subjected to the ½ horizontal folding, the fourth conveyor motor M32 is immediately operated rearward to deliver the garment C to the fourth folding layer 240 via the rear end of the fourth conveyor 232. The process to be performed after the garment C is delivered to the fourth folding layer 240 without being subjected to the ½ horizontal folding process will be described below with reference to FIGS. 12 to 15.

If the garment C is set in advance as an object to be subjected to the ½ horizontal folding, the fourth conveyor motor M32 is operated rearward immediately when the tip of the garment C reaches the front end of the third conveyor 231.

Thereafter, when the third-conveyor-rear-end garment detection sensor SC3 detects that the rear end of the garment C has passed through the rear end of the third conveyor 231, the third conveyor motor M31 and the fourth conveyor motor M32 are stopped, and a garment passage time Tc from a point in time at which the tip of the garment C reaches the rear end of the third conveyor 231 to a point in time at which the rear end of the garment C passes through the rear end of the third conveyor 231 is calculated by a timer 440.

Next, in order to prepare the ½ horizontal folding, the third conveyor motor M31 and the fourth conveyor motor M32 are operated forward for the time Tc/2 half the calculated garment passage time Tc, such that a ½ portion of the garment C is disposed in the longitudinal direction above a first folding gap G1 defined between the third conveyor 231 and the fourth conveyor 232.

When the preparation of the ½ horizontal folding for the garment C is completed, the first horizontal folding assembly 233 disposed above the third conveyor 231 and the fourth conveyor 232 is operated.

As an example, the first horizontal folding assembly 233 may operate in such a way as to push the ½ portion of the garment C at least partially into the first folding gap G1 using a first-folding-bar 2331 that reciprocates in the upward/downward direction. The first horizontal folding assembly 233 may include a first-folding-bar driving motor M33 configured to operate the first-folding-bar 2331, a crank member (not illustrated) configured to convert a rotational motion of the first-folding-bar driving motor M33 into a rectilinear reciprocating motion, and a first-folding-bar position sensor SFB1 configured to directly or indirectly detect a position of the second folding bar 2441.

As an example, the embodiment in which the first horizontal folding assembly 233 includes the first-folding-bar 2331, the first-folding-bar driving motor M33, and the crank member will be described, but the present disclosure is not limited thereto.

Meanwhile, a second horizontal folding assembly 244 and a third horizontal folding assembly 245, which will be described below, have the same structure and operate in the same manner as the first horizontal folding assembly 233.

As illustrated in FIG. 11, when the first-folding-bar driving motor M33 operates, the first-folding-bar 2331 rectilinearly moves downward from an initial position toward the first folding gap G1, pushes the ½ portion of the garment C at least partially into the first folding gap G1, and then returns back to the initial position by the operation of the crank member.

The first folding bar position sensor SFB1 detects whether the first folding bar 2331 begins to move from the initial position and then returns back to the initial position. FIG. 11 illustrates an embodiment in which the first folding bar position sensor SFB1 is provided in the form of a micro switch, but the present disclosure is not limited thereto. Any means well known in the art may be applied without limitation as long as this means may detect the position of the first folding bar 2331. For convenience, the first folding bar position sensor SFB1 provided in the form of a micro switch will be described below, and both a second folding bar position sensor SFB2 and a third folding bar position sensor SFB3 will be described below with reference to the embodiment in which the micro switch is applied.

When the first folding bar position sensor SFB1 detects that the operation of the first folding bar 2331 is completed, the third conveyor motor M31 operates rearward and the fourth conveyor motor M32 operates forward so that the garment C may pass through the first folding gap G1 while being subjected to the ½ horizontal folding.

Meanwhile, because there is a likelihood that the garment lumping occurs while the garment C passes through the first folding gap G1, the garment lumping determination criterion may be similarly applied.

That is, a lower side of a third folding gap G3 is a target position at which whether the garment successfully passes through the first folding gap G1 and is conveyed to the fourth folding layer 240 is determined. To this end, a fourth-conveyor-lower-part garment detection sensor SC4 is provided at the lower side of the fourth conveyor 232 and disposed at a position adjacent to the first folding gap G1.

Like the garment detection sensors, the fourth-conveyor-lower-part garment detection sensor SC4 is an IR sensor. However, since the fourth-conveyor-lower-part garment detection sensor SC4 performs a function of detecting whether the garment C passes through the first folding gap G1, the fourth-conveyor-lower-part garment detection sensor SC4 is disposed at a position exposed from the fourth conveyor 232, unlike the garment detection sensors.

The fourth-conveyor-lower-part garment detection sensor SC4 detects whether the rear end of the garment C passes the first folding gap G1 after the tip of the garment C reaches the first folding gap G1. It may be determined that the lumping of the garment C has occurred when the passage of the garment C is not detected in a case in which the rear end of the garment C does not pass through the first folding gap G1 or a motor current value supplied to the third conveyor motor M31 or the fourth conveyor 232 is excessively large even though a predetermined delay time elapses after the rearward operation of the third conveyor motor M31 and the forward operation of the fourth conveyor motor M32 are initiated.

In more detail, it may be determined that the lumping of the garment C has occurred in the first folding gap G1 in the third folding layer 230 when a fourth delay time T4 is equal to or larger than a predetermined fourth critical delay time Tth4 or a fourth motor current value A4 supplied to the third conveyor motor M31 and the fourth conveyor motor M32 is equal to or larger than a predetermined fourth critical motor current value Ath4 after the rearward operation of the third conveyor motor M31 and the forward operation of the fourth conveyor motor M32 are initiated in a state in which it is determined, based on the output signal from the fourth-conveyor-lower-part garment detection sensor SC4, that the rear end of the garment C does not pass through the lower side of the first folding gap G1 and the lower side of the fourth conveyor 232, which are target positions.

As described above, when it is determined that the lumping of the garment C has occurred in the first folding gap G1, the supply of power to the third conveyor motor M31 and the fourth conveyor motor M32 is cut off to prevent overloads of the third conveyor motor M31 and the fourth conveyor motor M32 and prevent damage to the garment C and the components.

In this case, the fourth critical delay time Tth4 may be smaller than the third critical delay time Tth3, and particularly set to about 5 seconds which is half the third critical delay time Tth3 because the garment C is subjected to the ½ horizontal folding.

In addition, like the first critical motor current value Ath1 and the second critical motor current value Ath2, the fourth critical motor current value Ath4 may be set to about 2 A when the third conveyor motor M31 and the fourth conveyor motor M32 have the same output as the first conveyor motor M1 and the second conveyor motor M21. The fourth critical motor current value Ath4 may be set to be different from the first critical motor current value Ath1 and the second critical motor current value Ath2 when the third conveyor motor M31 and the fourth conveyor motor M32 are motors having outputs different from the outputs of the first conveyor motor M1 and the second conveyor motor M21.

In addition, when it is determined that the lumping of the garment C has occurred in the first folding gap G1 as described above, an alarm including fourth error information indicating that the lumping of the garment C has occurred in the first folding gap G1 is generated and transferred to the user through the display unit and the alarm unit.

Meanwhile, when the fourth-conveyor-lower-part garment detection sensor SC4 detects that the rear end of the garment C successfully passes the first folding gap G1 after the tip of the garment C reaches the first folding gap G1, the third conveyor motor M31 and the fourth conveyor motor M32 are stopped, and the conveying and folding processes in the third folding layer 230 are ended.

FIGS. 12 to 15 illustrate a process of delivering the garment to the fourth folding layer 240 and a process of performing ⅓ horizontal folding in the fourth folding layer 240 without performing the ½ horizontal folding process in the third folding layer 230.

In both a case in which the ½ horizontal folding is performed in the third folding layer 230 and a case in which the ½ horizontal folding is not performed in the third folding layer 230, the ½ horizontal folding may be performed in the same or similar manner as that in the third folding layer 230 or the ⅓ horizontal folding may be performed twice on the garment C delivered to the fourth folding layer 240.

Therefore, the process of performing the ½ horizontal folding and the process of performing the ⅓ horizontal folding twice on the garment C that has not be subjected to the ½ horizontal folding in the third folding layer 230 will be described below with reference to FIGS. 12 to 15, and descriptions of other repetitive processes will be omitted.

The garment lumping determination criterion, which is applied to the first to third folding layers 210, 220, and 230, may be similarly applied to the process of delivering the garment C from the third folding layer 230 to the fourth folding layer 240 and the ⅓ horizontal folding process.

In the fourth folding layer 240, the fifth conveyor 241 is disposed at the rearmost side, the seventh conveyor 243 is disposed at the front side of the fifth conveyor 241, and the sixth conveyor 242 is disposed between the fifth conveyor 241 and the seventh conveyor 243.

In this case, each of the fifth conveyor 241 and the seventh conveyor 243 is provided to convey the garment C to the front end or the rear end of the conveyor. In addition, the sixth conveyor 242 may be provided to convey the garment C together with the fifth conveyor 241 and the seventh conveyor 243 and to rotate in a direction opposite to a direction of the fifth conveyor 241 or the seventh conveyor 243 at the time of performing the horizontal folding.

The garment C conveyed from the rear end of the fourth conveyor 232 in the third folding layer 230 is delivered first to the fifth conveyor 241 disposed at a rearmost side among the plurality of conveyors in the fourth folding layer 240, and delivered to the seventh conveyor 243 disposed to be spaced apart from the sixth conveyor 242 while defining a third folding gap G3, via the sixth conveyor 242 disposed to be spaced apart from the fifth conveyor 241 while defining a second folding gap G2.

Therefore, a rear end of the seventh conveyor 243 disposed at a front side of the fourth folding layer 240 is a target position at which whether the garment C is successfully conveyed to the fourth folding layer 240 is determined.

To this end, a seventh-conveyor-rear-end garment detection sensor SC7 is provided on the seventh conveyor 243 and detects whether the tip of the garment C has reached the corresponding target position. Like the above-mentioned garment detection sensors, the seventh-conveyor-rear-end garment detection sensor SC7 is an IR sensor. That is, the seventh-conveyor-rear-end garment detection sensor SC7 may be disposed at the rear end of the seventh conveyor 243, may detect whether the garment C is present at the target position, and may generate a detection signal.

The seventh-conveyor-rear-end garment detection sensor SC7 detects whether the tip of the garment C has reached the rear end of the seventh conveyor in the fourth folding layer 240. In the case in which whether the garment C reaches the rear end of the seventh conveyor is not detected by the seventh-conveyor-rear-end garment detection sensor SC7, it may be determined that the lumping of the garment C has occurred when the tip of the garment C does not reach the rear end of the seventh conveyor 243 or the motor current value supplied to the fifth conveyor motor M41, the sixth conveyor motor M42, and the seventh conveyor motor M43 is excessively large even though a predetermined delay time elapses after the forward operations of the fifth conveyor motor M41, the sixth conveyor motor M42, and the seventh conveyor motor M43 are initiated to convey the garment C.

In more detail, it may be determined that the lumping of the garment C has occurred in the fourth folding layer 240 when a fifth delay time T5 is equal to or larger than a predetermined fifth critical delay time Tth5 or a fifth motor current value A5 applied to the fifth conveyor motor M41, the sixth conveyor motor M42, and the seventh conveyor motor M43 is equal to or larger than a predetermined fifth critical motor current value Ath5 after the forward operations of the fifth conveyor motor M41, the sixth conveyor motor M42, and the seventh conveyor motor M43 are initiated in a state in which it is determined, based on the output signal from the seventh-conveyor-rear-end garment detection sensor SC7, that the tip of the garment C does not reach the rear end of the seventh conveyor 243 which is a target position.

As described above, when it is determined that the lumping of the garment C has occurred in the fourth folding layer 240, the supply of power to the fifth conveyor motor M41, the sixth conveyor motor M42, and the seventh conveyor motor M43 is cut off to prevent overloads of the fifth conveyor motor M41, the sixth conveyor motor M42, and the seventh conveyor motor M43 and prevent damage to the garment C and the components.

In this case, like the first critical delay time Tth1 and the second critical delay time Tth2, the fifth critical delay time Tth5 may be set to about 10 seconds because the garment C is not horizontally folded and the length of the garment C is maintained constantly.

In addition, like the first to fourth critical motor current values Ath1, Ath2, Ath3, and Ath4, the fifth critical motor current value Ath5 may be set to about 2 A when the fifth conveyor motor M41, the sixth conveyor motor M42, and the seventh conveyor motor M43 have the same output as the first to fourth conveyor motors M1, M21, M31, and M41. The fifth critical motor current value Ath5 may be set to be different from the first to fourth critical motor current values Ath1, Ath2, Ath3, and Ath4 when the fifth conveyor motor M41, the sixth conveyor motor M42, and the seventh conveyor motor M43 are motors having the output different from the output of the first to fourth conveyor motors M1, M21, M31, and M41.

In addition, when it is determined that the lumping of the garment C has occurred in the fourth folding layer 240 as described above, an alarm including fifth error information indicating that the lumping of the garment C has occurred in the fourth folding layer 240 is generated and transferred to the user through the display unit and the alarm unit.

Meanwhile, when it is determined, based on the output signal from the seventh-conveyor-rear-end garment detection sensor SC7, that the tip of the garment C has reached the rear end of the seventh conveyor 243 which is a target position, the fifth conveyor motor M41, the sixth conveyor motor M42, and the seventh conveyor motor M43 are additionally operated until the rear end of the garment C reaches the rear end of the seventh conveyor 243.

Thereafter, when the seventh-conveyor-rear-end garment detection sensor SC7 detects that the rear end of the garment C has passed through the rear end of the seventh conveyor 243, the fifth conveyor motor M41, the sixth conveyor motor M42, and the seventh conveyor motor M43 are stopped, and the garment passage time Tc from the point in time at which the tip of the garment C reaches the rear end of the seventh conveyor 243 to the point in time at which the rear end of the garment C passes through the rear end of the seventh conveyor 243 is calculated by the timer 440.

When the passage time Tc is calculated, the next process is determined depending on whether the garment C is subjected to the ½ horizontal folding or the ⅓ horizontal folding.

First, when the garment C is subjected to the ½ horizontal folding, the ½ horizontal folding process is performed using the third folding gap G3 provided between the sixth conveyor 242 and the seventh conveyor 243.

In more detail, in order to prepare the ½ horizontal folding, the fifth conveyor motor M41, the sixth conveyor motor M42, and the seventh conveyor motor M43 are operated rearward for the time Tc/2 half the calculated garment passage time Tc, such that the ½ portion of the garment C is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 are stopped.

When the preparation of the ½ horizontal folding for the garment C is completed, the third horizontal folding assembly 245 disposed above the sixth conveyor 242 and the seventh conveyor 243 is operated.

As described above, the third horizontal folding assembly 245 has the same structure and operates in the same manner as the first horizontal folding assembly 233.

Figure 13:
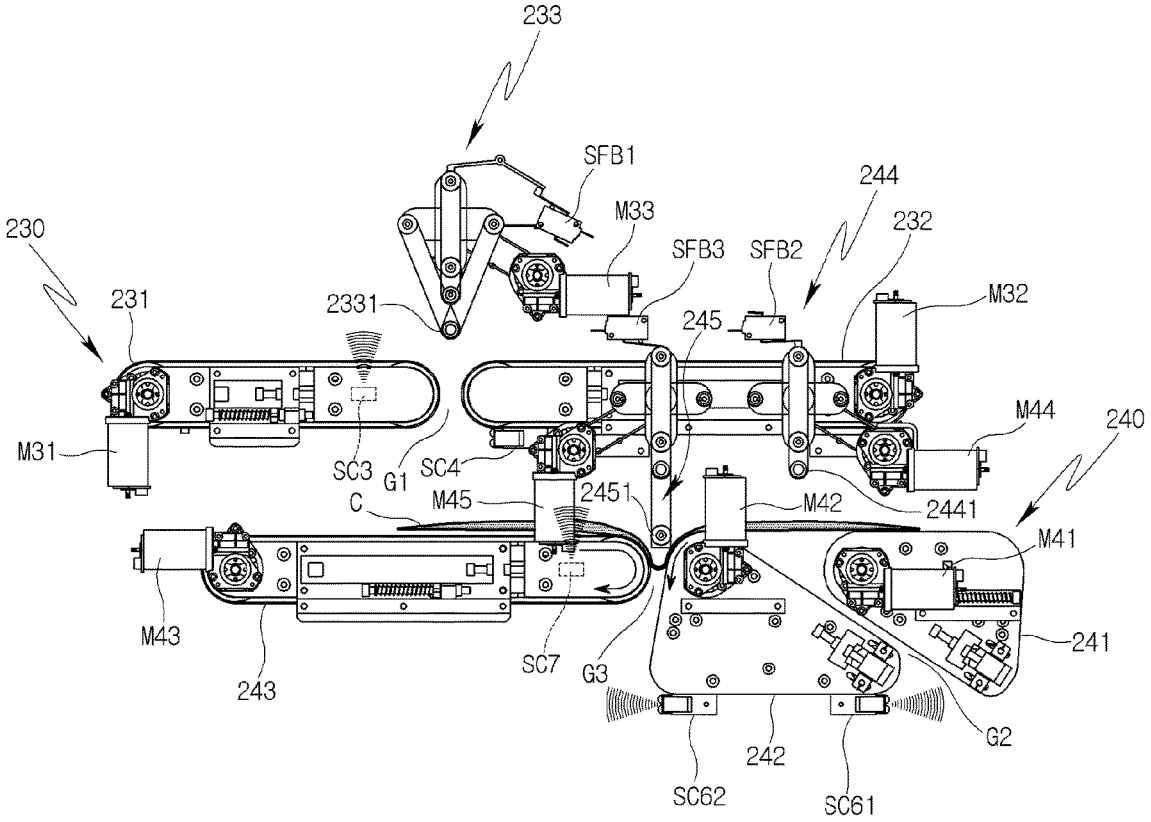

In more detail, as illustrated in FIG. 13, when a third folding bar driving motor M45 operates, a third folding bar 2451 rectilinearly moves downward from an initial position toward the third folding gap G3, pushes the ½ portion of the garment C at least partially into the third folding gap G3, and then returns back to the initial position by the operation of a crank member.

A third folding bar position sensor SFB3, which is a micro switch, detects whether the third folding bar 2451 begins to move from the initial position and returns back to the initial position.

When the third folding bar position sensor SFB3 detects that the operation of the third folding bar 2451 is completed, the seventh conveyor motor M43 operates rearward and the fifth conveyor motor M41 and the sixth conveyor motor M42 operate forward so that the garment C may pass through the third folding gap G3 while being subjected to the ½ horizontal folding. The garment C on which the ½ horizontal folding is completely performed is delivered to the unloading layer 310 disposed below the third folding gap G3.

Meanwhile, because there is a likelihood that the garment lumping occurs while the garment C passes through the third folding gap G3, the garment lumping determination criterion may be similarly applied.

That is, the lower side of the third folding gap G3 is a target position at which whether the garment successfully passes through the third folding gap G3 and is conveyed to the unloading layer 310. To this end, a sixth-conveyor-front-lower-part garment detection sensor SC62 is provided at a front lower side of the sixth conveyor 242 and disposed at a position adjacent to the third folding gap G3.

Like the garment detection sensors, the sixth-conveyor-front-lower-part garment detection sensor SC62 is an IR sensor. However, since the sixth-conveyor-front-lower-part garment detection sensor SC62 performs a function of detecting whether the garment C passes through the third folding gap G3, the sixth-conveyor-front-lower-part garment detection sensor SC62 is disposed at a position exposed from the sixth conveyor 242, like the fourth-conveyor-lower-part garment detection sensor SC4.

The sixth-conveyor-front-lower-part garment detection sensor SC62 detects whether the rear end of the garment C passes the third folding gap G3 after the tip of the garment C reaches the third folding gap G3. It may be determined that the lumping of the garment C has occurred when the passage of the garment C is not detected in a case in which the rear end of the garment C does not pass through the third folding gap G3 or a motor current value supplied to the fifth to seventh conveyors motor M41, M42, and M43 is excessively large even though a predetermined delay time elapses after the seventh conveyor motor M43 operates rearward and the fifth conveyor motor M41 and the sixth conveyor motor M42 operate forward.

In more detail, it may be determined that the lumping of the garment C has occurred in the third folding gap G3 in the fourth folding layer 240 when a sixth delay time T6 is equal to or larger than a predetermined sixth critical delay time Tth6 or a sixth motor current value A6 supplied to the fifth to seventh conveyor motors M41, M42, and M43 is equal to or larger than a predetermined sixth critical motor current value Ath6 after the rearward operation of the seventh conveyor motor M43 and the forward operations of the fifth conveyor motor M41 and the sixth conveyor motor M42 are initiated in a state in which it is determined, based on the output signal of the sixth-conveyor-front-lower-part garment detection sensor SC62, that the rear end of the garment C does not pass through the lower side of the third folding gap G3 and the lower side of the sixth conveyor 242 which are target positions.

As described above, when it is determined that the lumping of the garment C has occurred in the third folding gap G3, the supply of power to the fifth to seventh conveyor motors M41, M42, and M43 is cut off to prevent overloads of the fifth to seventh conveyor motors M41, M42, and M43 and prevent damage to the garment C and the components.

In this case, the sixth critical delay time Tth6 may be smaller than the fifth critical delay time Tth5, and particularly set to about 5 seconds which is half the fifth critical delay time Tth5 because the garment C is subjected to the ½ horizontal folding.

In addition, like the above-mentioned critical motor current values, the sixth critical motor current value Ath6 may be set to about 2 A when the fifth to seventh conveyor motors M41, M42, and M43 have the same output as the other conveyor motors. The sixth critical motor current value Ath6 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the third folding gap G3 as described above, an alarm including sixth error information indicating that the lumping of the garment C has occurred in the first folding layer 210 is generated and transferred to the user through the display unit and the alarm unit.

Meanwhile, when the sixth-conveyor-front-lower-part garment detection sensor SC62 detects that the rear end of the garment C successfully passes the third folding gap G3 after the tip of the garment C reaches the third folding gap G3, the fifth to seventh conveyor motors M41, M42, and M43 are stopped, and the conveying and folding processes in the fourth folding layer 240 are ended.

Next, when the garment C is subjected to the ⅓ horizontal folding, primary ⅓ horizontal folding is performed using the second folding gap G2 provided between the fifth conveyor 241 and the sixth conveyor 242, and secondary ⅓ horizontal folding process is performed using the third folding gap G3 provided between the sixth conveyor 242 and the seventh conveyor 243.

In more detail, in order to prepare the primary ⅓ horizontal folding, the fifth conveyor motor M41, the sixth conveyor motor M42, and the seventh conveyor motor M43 are operated rearward for the time (Tc*⅔) which is ⅔ of the garment passage time Tc, such that a ⅔ portion of the garment C is disposed in the longitudinal direction above the second folding gap G2 provided between the fifth conveyor 241 and the sixth conveyor 242, and the fifth conveyor motor M41, the sixth conveyor motor M42, and the seventh conveyor motor M43 are stopped.

When the preparation of the primary ⅓ horizontal folding for the garment C is completed, a second horizontal folding assembly 244 disposed above the fifth conveyor 241 and the sixth conveyor 242 is operated.

As described above, the second horizontal folding assembly 244 has the same structure and operates in the same manner as the first horizontal folding assembly 233.

Figure 14:
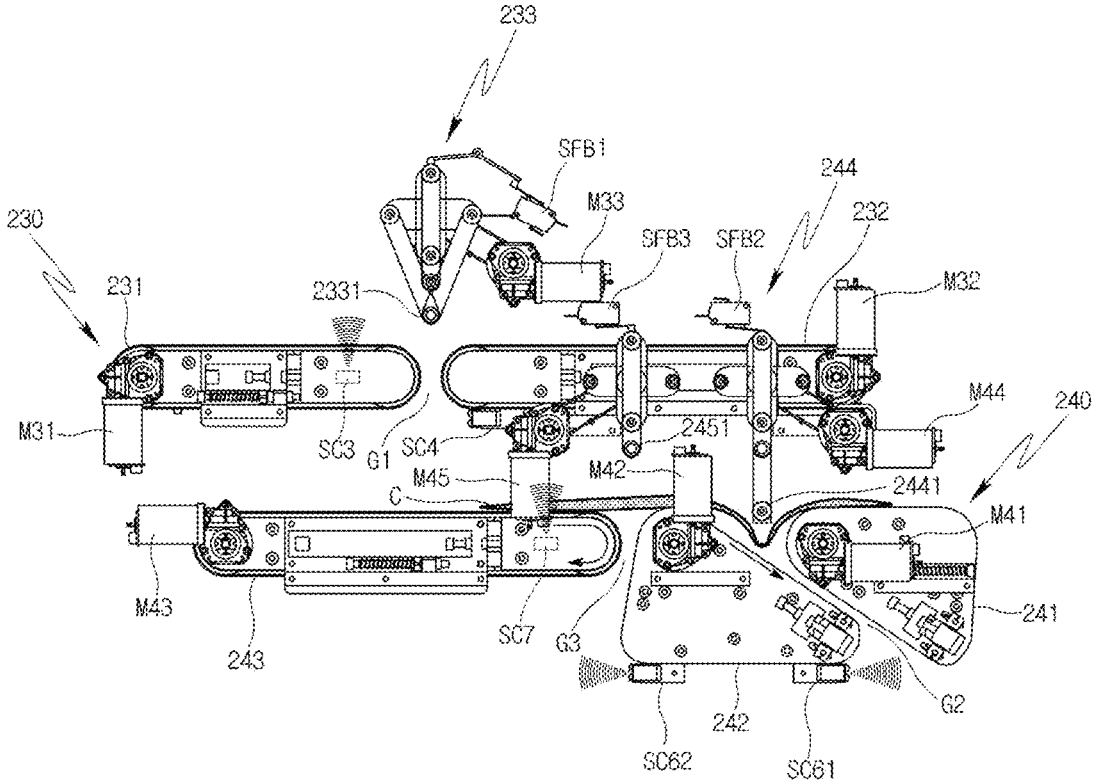
Figure 15:
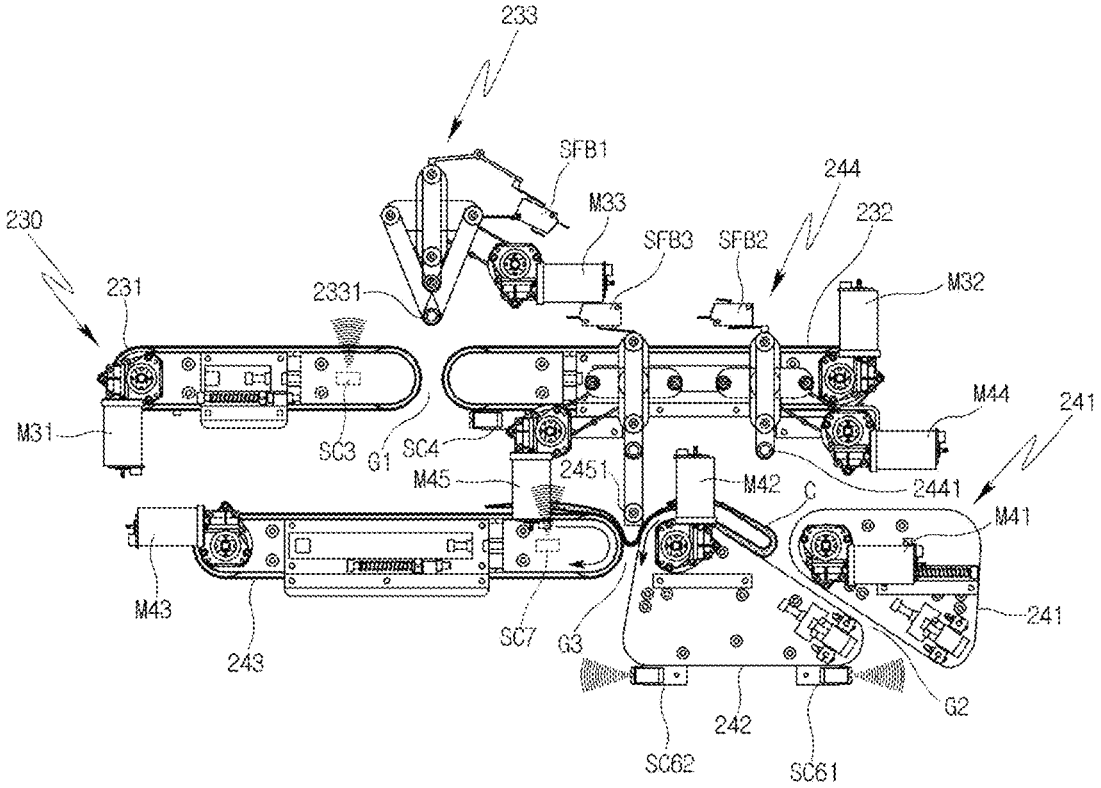

In more detail, as illustrated in FIG. 14, when a second folding bar driving motor M44 operates, a second folding bar 2441 rectilinearly moves downward from an initial position toward the second folding gap G2, pushes the ⅔ portion of the garment C at least partially into the second folding gap G2, and then returns back to the initial position by the operation of a crank member.

A second folding bar position sensor SFB2, which is a micro switch, detects whether the second folding bar 2441 begins to move from the initial position and returns back to the initial position.

When the second folding bar position sensor SFB2 detects that the operation of the second folding bar 2441 is completed, the fifth conveyor motor M41 operates forward and the sixth conveyor motor M42 and the seventh conveyor motor M43 operate rearward so that the garment C is subjected to the primary ⅓ horizontal folding.

In this case, whether the primary ⅓ horizontal folding process is successfully performed is determined based on whether the tip of the garment C, which has been subjected to the ⅓ horizontal folding through the second folding gap G2, reaches the rear lower side of the sixth conveyor 242.

To this end, a sixth-conveyor-rear-lower-part garment detection sensor SC61 is provided at a rear lower side of the sixth conveyor 242.

Like the garment detection sensors, the sixth-conveyor-rear-lower-part garment detection sensor SC61 is an IR sensor. However, since the sixth-conveyor-rear-lower-part garment detection sensor SC61 performs a function of detecting whether the garment C reaches the lower side of the second folding gap G2, the sixth-conveyor-rear-lower-part garment detection sensor SC61 is disposed at a position exposed from the sixth conveyor 242, like the fourth-conveyor-front-lower-part garment detection sensor SC62.

The sixth-conveyor-rear-lower-part garment detection sensor SC61 detects that the tip of the garment C reaches the lower side of the second folding gap G2. It may be determined that the lumping of the garment C has occurred when whether the garment C reaches the lower side of the second folding gap G2 is not detected in a case in which the tip of the garment C does not reach the lower side of the second folding gap G2 or a motor current value supplied to the fifth to seventh conveyor motors M41, M42, and M43 is excessively large even though a predetermined delay time elapses after the fifth conveyor motor M41 operates forward and the sixth conveyor motor M42 and the seventh conveyor motor M43 operate rearward.

In more detail, it may be determined that the lumping of the garment C has occurred in the second folding gap G2 in the fourth folding layer 240 when a seventh delay time T7 is equal to or larger than a predetermined seventh critical delay time Tth7 or a seventh motor current value A7 supplied to the fifth to seventh conveyor motors M41, M42, and M43 is equal to or larger than a predetermined seventh critical motor current value Ath7 after the forward operation of the fifth conveyor motor M41 and the rearward operations of the sixth conveyor motor M42 and the seventh conveyor motor M43 are initiated in a state in which it is determined, based on the output signal from the sixth-conveyor-rear-lower-part garment detection sensor SC61, that the tip of the garment C does not reach the lower side of the second folding gap G2 and the lower side of the sixth conveyor 242 which are target positions.

As described above, when it is determined that the lumping of the garment C has occurred in the second folding gap G2, the supply of power to the fifth to seventh conveyor motors M41, M42, and M43 is cut off to prevent overloads of the fifth to seventh conveyor motors M41, M42, and M43 and prevent damage to the garment C and the components.

In this case, the seventh critical delay time Tth7 may be smaller than the fifth critical delay time Tth5, and particularly set to about 7 seconds which is ⅔ of the fifth critical delay time Tth5 because the garment C is subjected to the primary ⅓ horizontal folding.

In addition, like the above-mentioned critical motor current values, the seventh critical motor current value Ath7 may be set to about 2 A when the fifth to seventh conveyor motors M41, M42, and M43 have the same output as the other conveyor motors. The seventh critical motor current value Ath7 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the second folding gap G2 as described above, an alarm including seventh error information indicating that the lumping of the garment C has occurred in the second folding gap G2 is generated and transferred to the user through the display unit and the alarm unit.

Meanwhile, when a seventh-conveyor-rear-lower-part garment detection sensor detects that the tip of the garment C has reached the seventh conveyor, the fifth conveyor motor M41 is operated rearward and the sixth conveyor motor M42 and the seventh conveyor motor M43 are operated forward for the time (Tc*⅔) which is ⅓ of the garment passage time Tc in order to prepare the secondary ⅓ horizontal folding process, such that a ⅓ portion of the garment C before the primary horizontal folding process is disposed in the longitudinal direction above the third folding gap G3 provided between the sixth conveyor 242 and the seventh conveyor 243, and the fifth conveyor motor M41, the sixth conveyor motor M42, and the seventh conveyor motor M43 are stopped.

When the preparation of the secondary ⅓ horizontal folding for the garment C is completed, the third horizontal folding assembly 245 disposed above the sixth conveyor 242 and the seventh conveyor 243 is operated.

The secondary horizontal folding process using the third horizontal folding assembly 245 and the third folding gap G3 may be performed in the same manner as the ½ horizontal folding process using the third horizontal folding assembly 245 and the third folding gap G3, and a detailed description thereof will be omitted.

In addition, the process of determining whether the lumping of the garment C occurs in the third folding gap G3 may be similarly performed in the secondary ⅓ horizontal folding process.

In more detail, it may be determined that the lumping of the garment C has occurred in the third folding gap G3 in the fourth folding layer 240 when an eighth delay time T8 is equal to or larger than a predetermined eighth critical delay time Tth8 or an eighth motor current value A8 supplied to the fifth to seventh conveyor motors M41, M42, and M43 is equal to or larger than a predetermined eighth critical motor current value Ath8 after the seventh conveyor motor M43 operates rearward and the fifth conveyor motor M41 and the sixth conveyor motor M42 operate forward in a state in which it is determined, based on the output signal from the sixth-conveyor-rear-lower-part garment detection sensor SC61, that the rear end of the garment C on which the secondary ⅓ horizontal folding is completely performed does not pass through the lower side of the third folding gap G3 and the lower side of the sixth conveyor 242 which are target positions.

As described above, when it is determined that the lumping of the garment C has occurred in the third folding gap G3, the supply of power to the fifth to seventh conveyor motors M41, M42, and M43 is cut off to prevent overloads of the fifth to seventh conveyor motors M41, M42, and M43 and prevent damage to the garment C and the components.

In this case, the eighth critical delay time Tth8 may be smaller than the fifth critical delay time Tth5, and particularly set to 3 seconds to 4 seconds which is ⅓ of the fifth critical delay time Tth5 because the garment C is subjected to the secondary ⅓ horizontal folding.

In addition, like the above-mentioned critical motor current values, the eighth critical motor current value Ath8 may be set to about 2 A when the fifth to seventh conveyor motors M41, M42, and M43 have the same output as the other conveyor motors. The eighth critical motor current value Ath8 may be set to be different from the above-mentioned critical motor current values when the fifth to seventh conveyor motors M41, M42, and M43 are motors having the output different from the output of the other conveyor motors.

In addition, when it is determined that the lumping of the garment C has occurred in the third folding gap G3 as described above, an alarm including eighth error information indicating that the lumping of the garment C has occurred in the third folding gap G3 is generated and transferred to the user through the display unit and the alarm unit.

Figure 16:
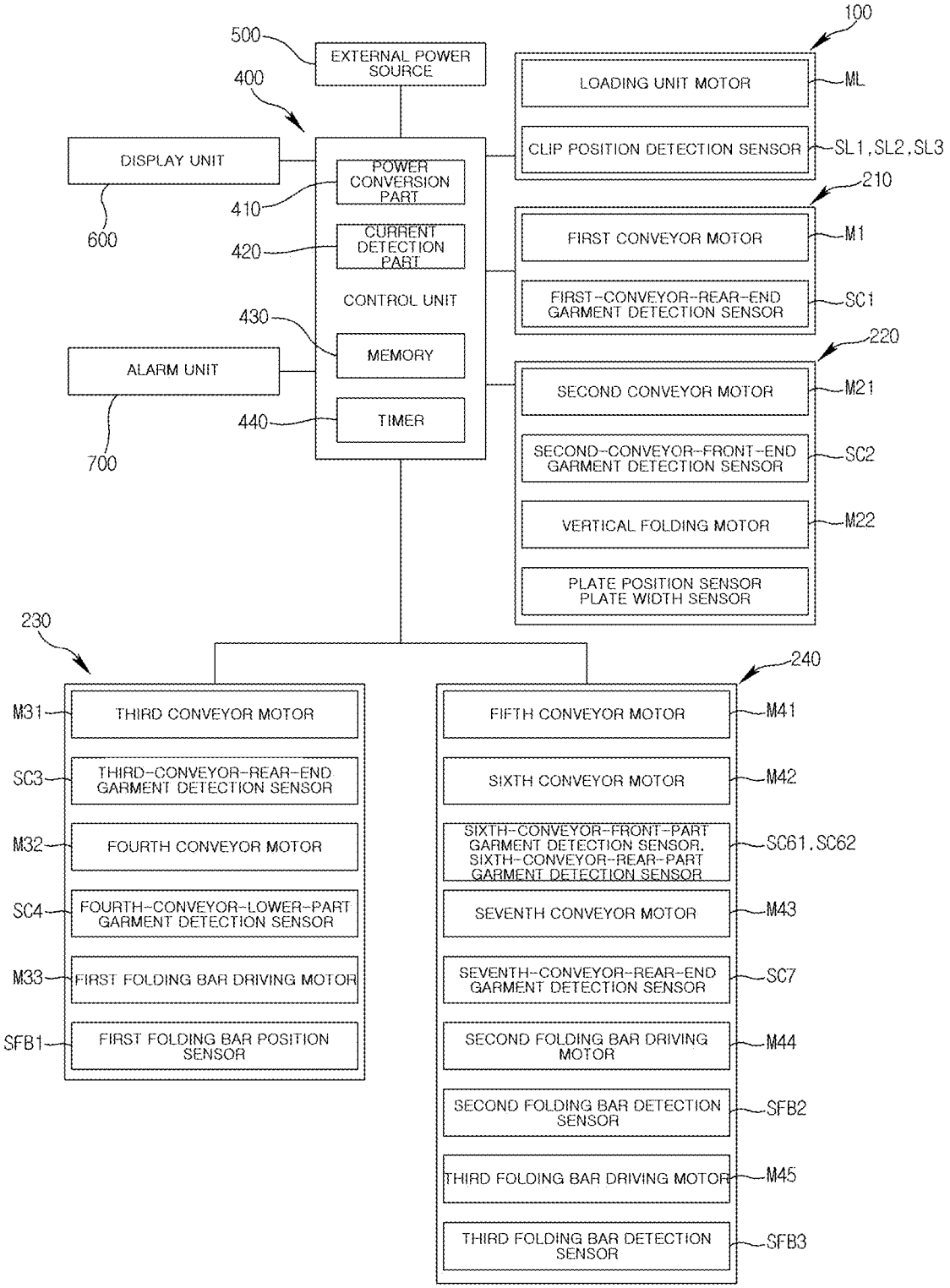
FIG. 16 is a block diagram for explaining a configuration for controlling the garment folding machine according to the present disclosure.

Meanwhile, FIG. 16 is a block diagram for explaining a configuration for controlling the garment folding machine according to the present disclosure.

Referring to FIG. 16, the garment folding machine according to the present disclosure may further include a control unit 400 configured to control the loading unit 100, the folding unit 200, and the unloading unit 300.

The control unit 400 is provided to control an operation of the garment folding machine 1 based on a user's instruction applied through an input unit (not illustrated). The control unit 400 may include a printed circuit board and elements mounted on the printed circuit board. When the user selects types of garments or folding courses through the input unit and then inputs a control instruction for the operation, the control unit 400 may control the operation of the garment folding machine 1 based on a preset algorithm.

The control unit 400 is electrically connected to the loading unit 100, the first folding layer 210, the second folding layer 220, the third folding layer 230, and the fourth folding layer 240 and generates a control signal for controlling the loading unit 100, the first folding layer 210, the second folding layer 220, the third folding layer 230, and the fourth folding layer 240. Although not illustrated, the control unit 400 may also be electrically connected to the unloading layer 310 and may control the unloading layer 310 so that the garment C, which is completely folded vertically or horizontally, is automatically accommodated in the discharge unit. A general configuration well known in the art may be applied in respect to the step of controlling the unloading layer 310, a specific description thereof will be omitted.

Meanwhile, the control unit 400 may be electrically connected to the input unit (not illustrated) to receive a user's control instruction, and electrically connected to the display unit 600 and the alarm unit 700 to provide the display unit 600 and the alarm unit 700 with the information on the operating state of the garment folding machine 1, thereby transmitting the corresponding information to the user.

In addition, the control unit 400 controls a power conversion part 410 and a current detection part 420, the power conversion part 410 converts power inputted from the external power source 500 and supplies the power to the loading unit 200, first to fourth folding layers 210, 220, 230, and 240, and the unloading layer 310, and the current detection part 420 detects the electric current supplied from the power conversion part 410 to the loading unit 200, the first to fourth folding layers 210, 220, 230, and 240, and the unloading layer 310.

In addition, the control unit 400 may further include a memory 430 configured to store information inputted in advance or inputted through the input unit (not illustrated), and the timer 440 capable of measuring the passage time of the garment C.

Meanwhile, the control unit 400 may be electrically connected to the loading unit 100, the folding unit 200, and the unloading unit 300 so as to transmit or receive signals therebetween. That is, the control unit 400 may be electrically connected to the components of the loading unit 100, the first folding layer 210, the second folding layer 220, the third folding layer 230, and the fourth folding layer 240 so as to transmit or receive signals therebetween.

For example, the control unit 400 may be electrically connected to the conveyor motors M1, M21, M22, M31, M41, M42, and M43 and the garment detection sensor SC1, SC2, SC3, SC4, SC5, SC61, SC62, and SC7 of the folding unit 200 so as to transmit or receive signals therebetween. As a result, the control unit 400 may receive detection signals in relation to the presence of the garment C from the garment detection sensors SC1, SC2, SC3, SC4, SC5, SC61, SC62, and SC7 and transmit drive control signals to the conveyor motors M1, M21, M22, M31, M41, M42, and M43.

In addition, the control unit 400 may be electrically connected to the vertical folding motor M22, the folding bar driving motors M33, M44, and M45, and the folding bar position sensor SFB1, SFB2, and SFB3 of the folding unit 200 so as to transmit or receive signals therebetween. As a result, the control unit 400 may receive signals in relation to positions of the folding bars from the folding bar position sensors SFB1, SFB2, and SFB3 and transmit drive control signals to the vertical folding motor M22 and the folding bar driving motors M33, M44, and M45.

With this configuration, the control unit 400 may determine whether the garment C reaches the target position, whether the garment C passes through the target position, and whether the lumping of the garment C occurs. Further, the control unit 400 may control the operations of the respective conveyor motors M1, M21, M22, M31, M41, M42, and M43 to generate differences in rotational speeds between the conveyors or change rotation directions of the respective conveyors. Therefore, the control unit 400 may move the garment C forward or rearward and perform the vertical folding or the horizontal folding on the garment C.

A specific control operation of the control unit 400 according to the present disclosure will be described below.

Meanwhile, during the use of the garment folding machine, lower garments, which have long lengths among the garments C, towels, or bedclothes are conveyed along the two or more folding layers and may be wrinkled during the conveying process.

In particular, the plurality of layers is vertically disposed in a narrow horizontal area due to a spatial restriction, spaces between the layers are narrow, and many components are provided to convey the garments between the layers. For this reason, the garment C is easily wrinkled during the process of conveying the garment C.

In order to solve the problem, the control unit 400 according to the present disclosure drops one end of the garment C having a long length to the outside of the conveyor during the process of conveying the garment C, thereby removing the wrinkles of the garment C by a weight of the garment C. Hereinafter, this configuration will be specifically described.

Figure 17:
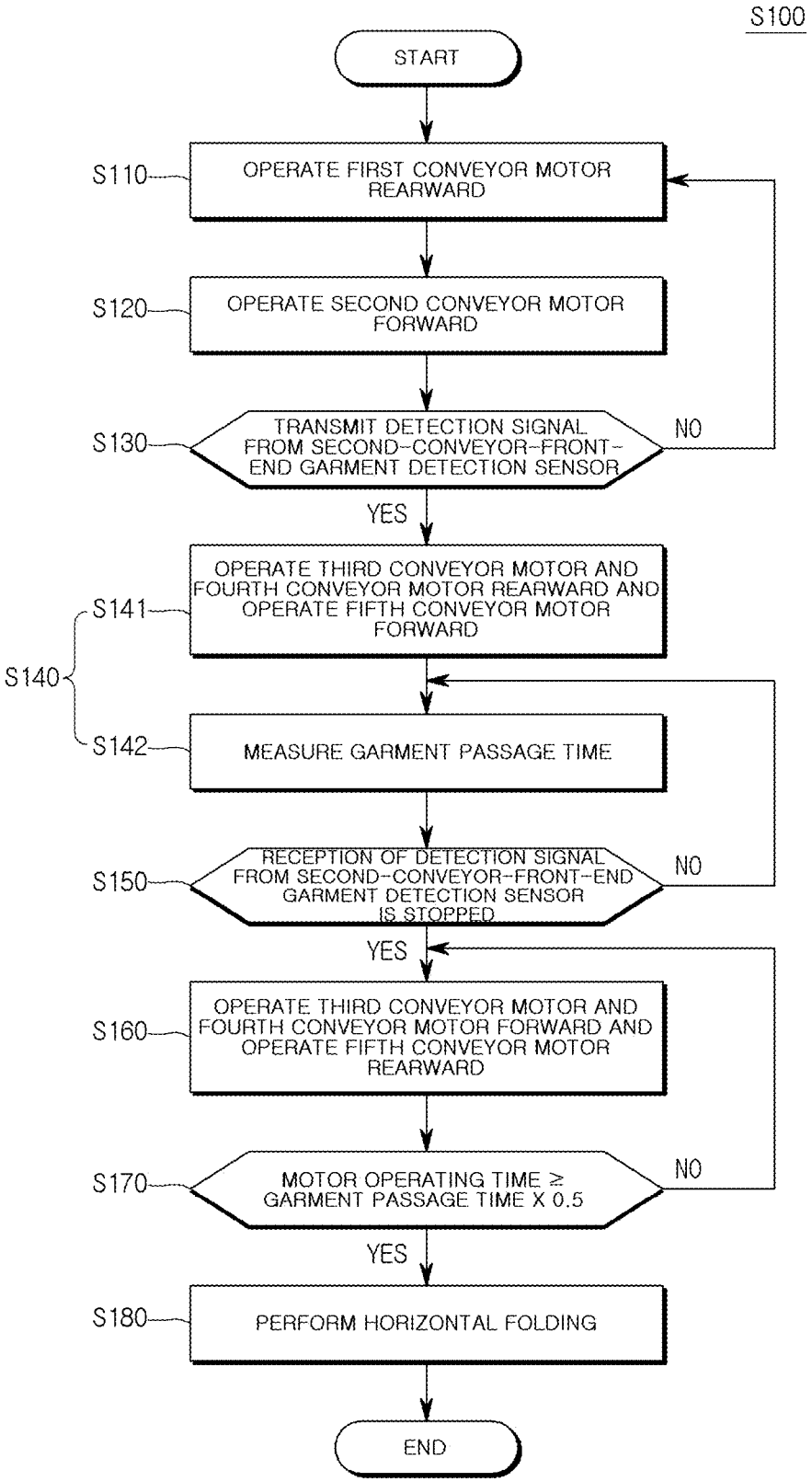
FIGS. 17 and 18 are flowcharts for explaining a method of controlling the garment folding machine according to the present disclosure.
Figure 18:
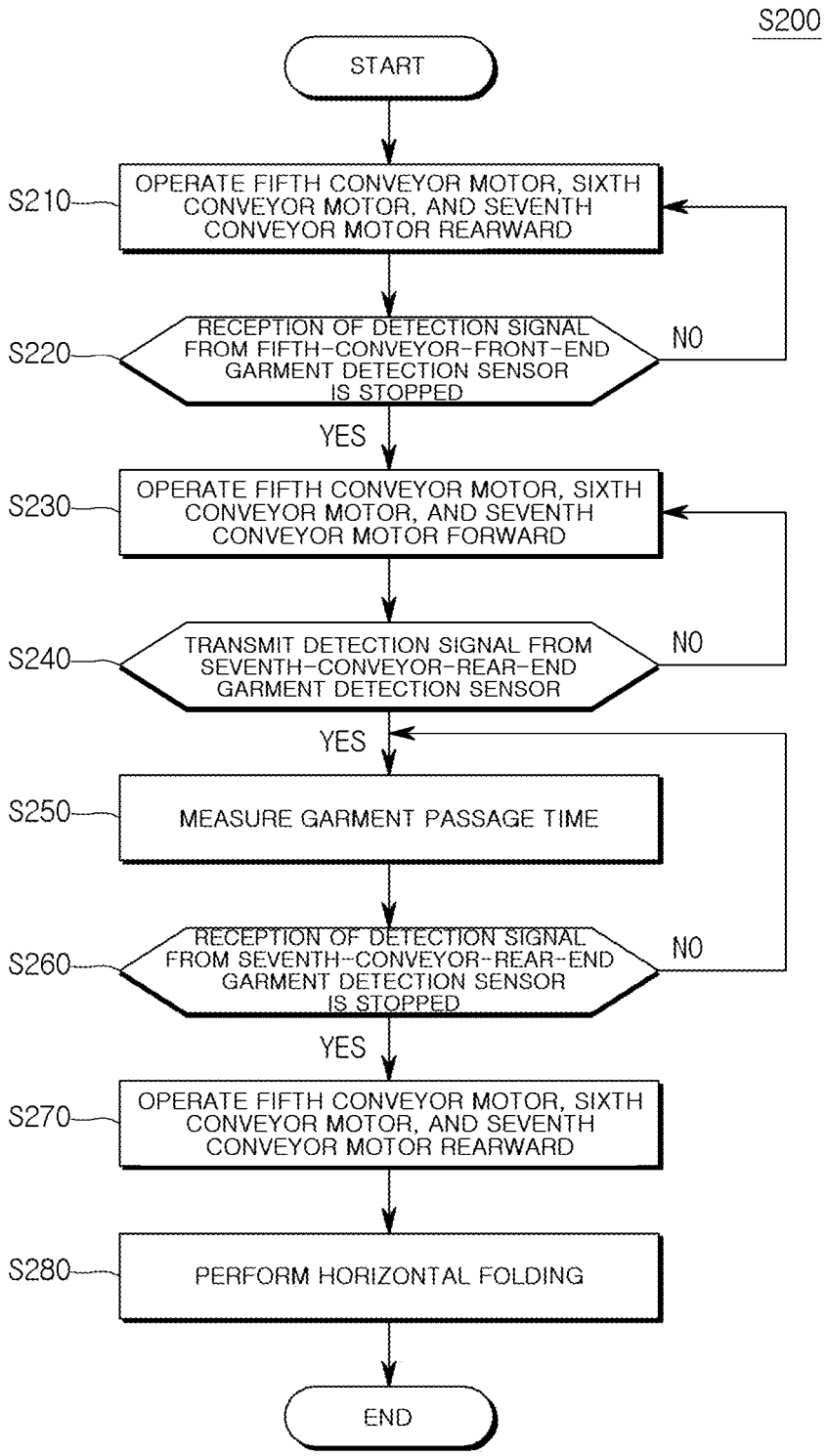
Figure 19:
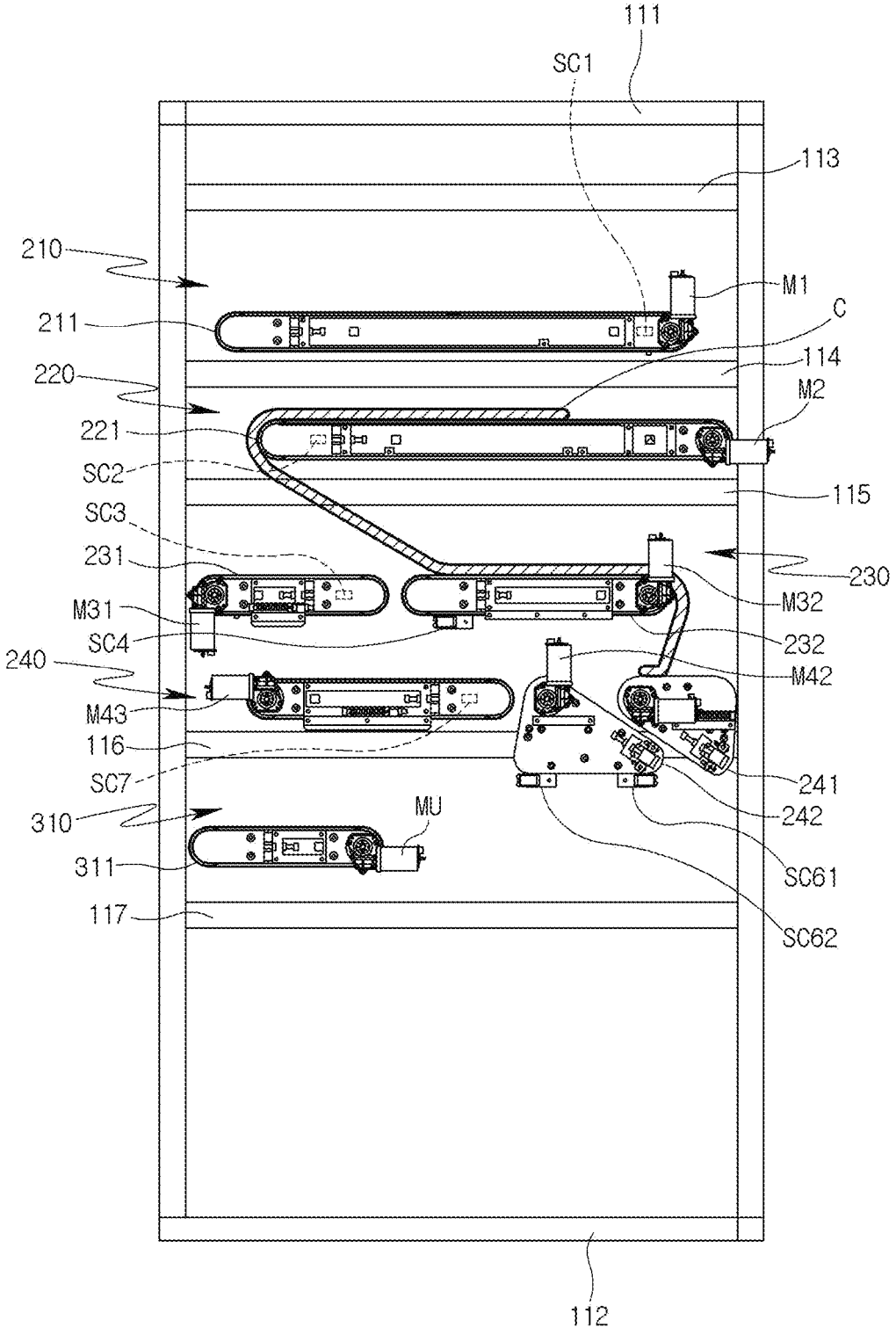
FIGS. 19 and 20 are views for schematically explaining situations in which wrinkles of the garment are removed while the garment is conveyed from the second folding layer to the third folding layer in the garment folding machine according to the present disclosure.
Figure 20:
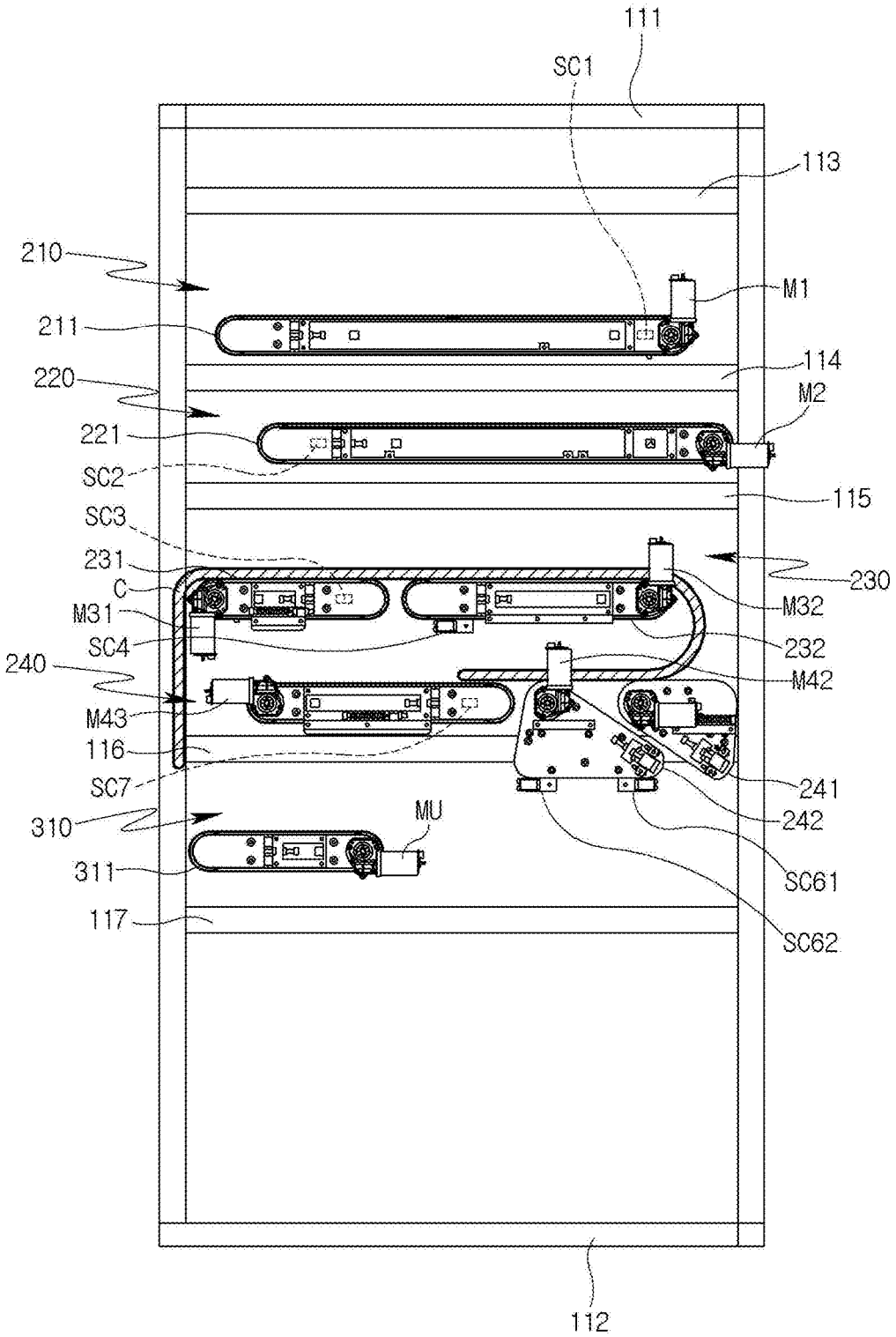
Figure 21:
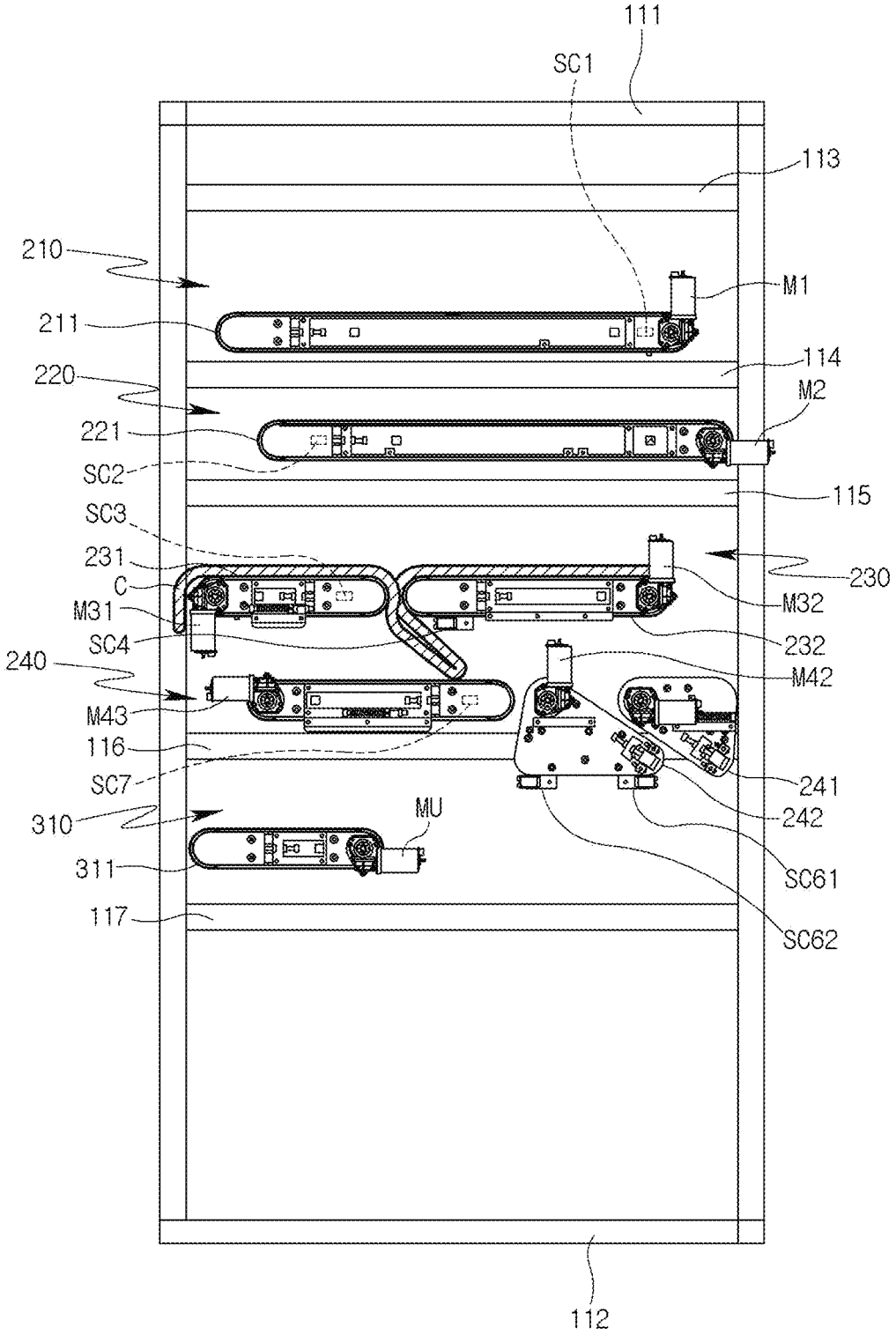
FIGS. 21 to 23 are views for schematically explaining situations in which wrinkles of the garment are removed while the garment is horizontally conveyed in the fourth folding layer in the garment folding machine according to the present disclosure.
Figure 22:
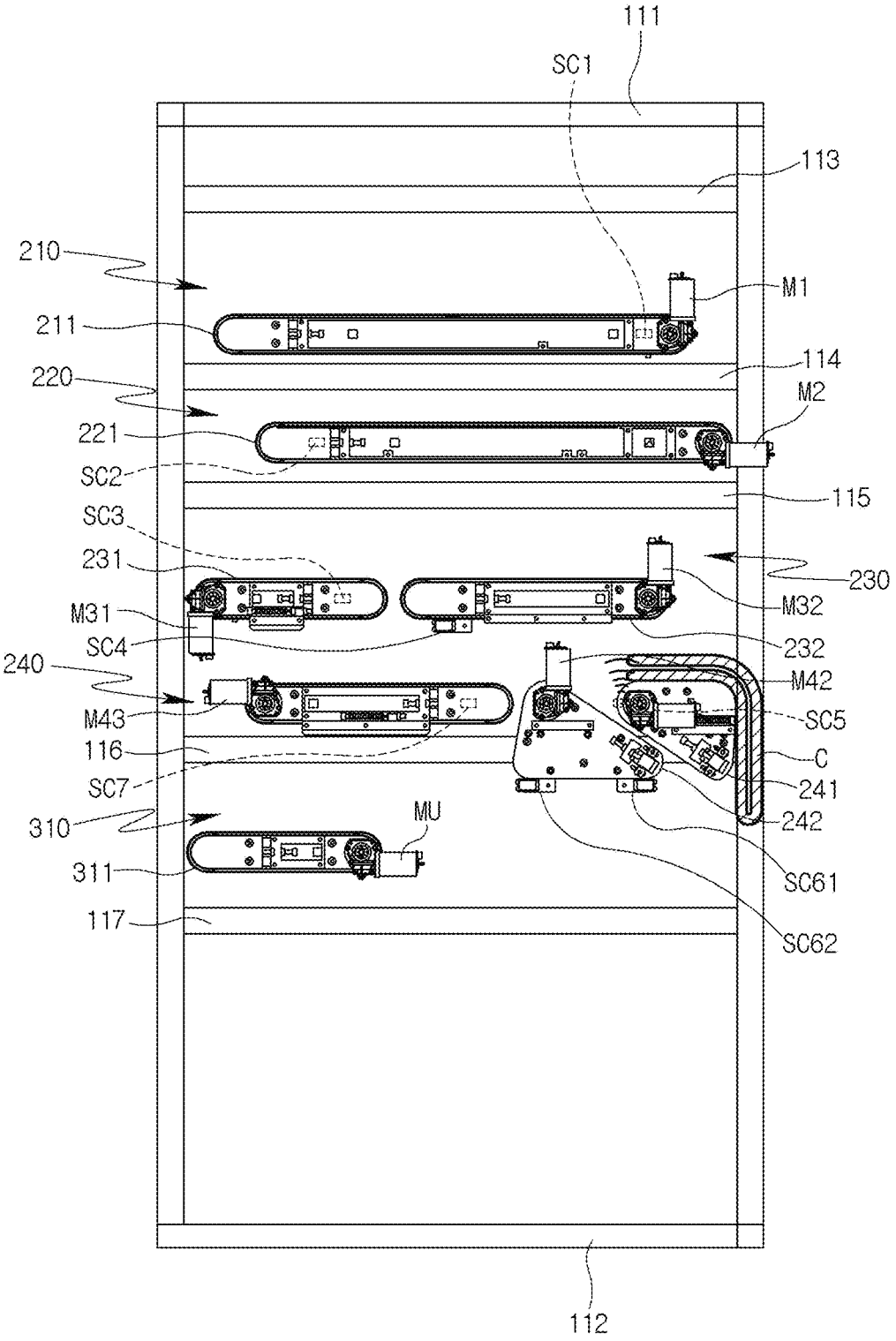
Figure 23:
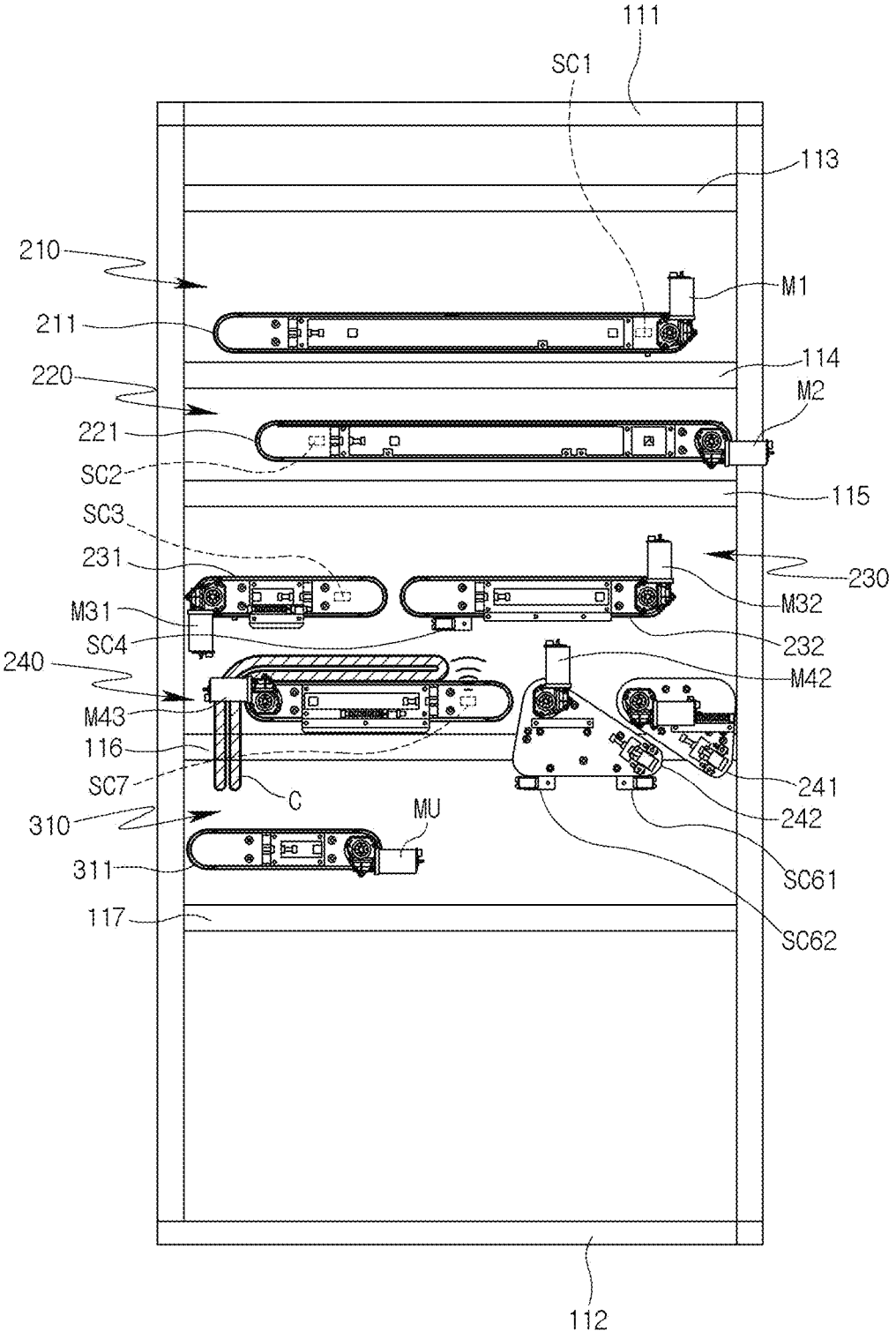

FIGS. 17 and 18 are flowcharts for explaining a method of controlling the garment folding machine according to the present disclosure, FIGS. 19 and 20 are views for schematically explaining situations in which wrinkles of the garment are removed while the garment is conveyed from the second folding layer to the third folding layer in the garment folding machine according to the present disclosure, and FIGS. 21 to 23 are views for schematically explaining situations in which wrinkles of the garment are removed while the garment is horizontally conveyed in the fourth folding layer in the garment folding machine according to the present disclosure.

The method of controlling the garment folding machine according to the present disclosure will be described with reference to FIGS. 17 to 23.

The method of controlling the garment folding machine according to the present disclosure includes a garment detecting step S10, a wrinkle removing step S20, and a horizontal folding step S30.

In the garment detecting step S10, when the conveyor motors M21, M31, M32, M41, M42, and M43 are operated and the garment C is conveyed, the sensors SC3, SC4, SC5, SC61, SC62, and SC7 disposed at the sides of the conveyors 231, 232, 241, 242, and 243 may detect the presence or absence of the garment C.

In this case, a length L (L=Tc×Vc) of the garment may be calculated by using a conveying speed Vc of the conveyor and the time Tc from a point in time at which the tip of the garment C enters a detection region of the sensor SC3, SC4, SC5, SC61, SC62, or SC7 to a point in time at which the rear end of the garment C completely passes through the detection region when the garment C is conveyed to one side of the conveyor 231, 232, 241, 242, or 243.

For example, when the tip of the garment C passes through the front end of the second conveyor 221, the second-conveyor-front-end garment detection sensor SC2 detects the presence of the garment C and transmits the detection signal. Further, the control unit 400 may receive the detection signal from the second-conveyor-front-end garment detection sensor SC2.

Further, when the tip of the garment C reaches the third-conveyor-rear-end garment detection sensor SC3, the third-conveyor-rear-end garment detection sensor SC3 transmits the detection signal to the control unit 400, and the control unit 400 may calculate the time Tc from a point in time at which the third-conveyor-rear-end garment detection sensor SC3 receives the detection signal to a point in time at which the third-conveyor-rear-end garment detection sensor SC3 stops transmitting the detection signal. A distance by which the third conveyor 231 rotates for the garment passage time Tc may be calculated by multiplying the garment passage time Tc by the conveying speed Vc of the third conveyor 231, and the calculated distance may mean the length L1 of the garment C.

As another example, when the rear end of the garment C reaches the rear end of the seventh conveyor 243 via the fifth conveyor 241 and the sixth conveyor 242, the seventh-conveyor-rear-end garment detection sensor SC7 transmits the detection signal, and the control unit 400 may receive the detection signal from the seventh-conveyor-rear-end garment detection sensor SC7.

Further, the control unit 400 may measure the time from a point in time at which the control unit 400 receives the detection signal from the seventh-conveyor-rear-end garment detection sensor SC7 to a point in time at which the reception of the detection signal from the seventh-conveyor-rear-end garment detection sensor SC7 is stopped. Therefore, the distance by which the seventh conveyor 243 rotates for a garment passage time Tc2 may be calculated by multiplying the garment passage time Tc2 by the conveying speed Vc of the seventh conveyor 243, and the calculated distance may mean a length L2 of the garment C folded horizontally.

In the wrinkle removing step S20, the conveyor motor M21, M31, M32, M41, M42, or M43 may be operated to drop one end of the garment C from the conveyor 231, 232, 241, 242, or 243 by the conveyor 231, 232, 241, 242, or 243.

The wrinkle removing step S20 may include a vertical-movement wrinkle removing step S21 and a horizontal-movement wrinkle removing step S22.

In the vertical-movement wrinkle removing step S21, the conveyor motors M21, M31, M32, M41, M42, and M43 in the plurality of folding layers 220 and 230 may be operated so that the garment C is conveyed between the plurality of folding layers 220 and 230 disposed in the upward/downward direction and one end of the garment C is dropped from the conveyor 231.

In this case, in the vertical-movement wrinkle removing step S21, a rotational speed of the conveyor motor M31 disposed at the lower side may be higher than a rotational speed of the conveyor motor M21 disposed at the upper side.

For example, when the control unit receives the detection signal from the second-conveyor-front-end garment detection sensor SC2, the control unit may operate the third conveyor motor M31 and the fourth conveyor motor M32 rearward and operate the fifth conveyor motor M41 forward. As a result, the third conveyor 231 and the fourth conveyor 232 may rotate to convey the garment C, which is conveyed and loaded from the second conveyor 221, toward the rear ends thereof. In addition, the fifth conveyor 241 may rotate forward in order to convey the garment C, which moves toward the fourth folding layer 240 while passing through the rear end of the fourth conveyor 232, toward the front end thereof.

With this configuration, the rear end of the garment C remaining on the second conveyor 221 may be dropped downward by being pulled by the third conveyor 231.

In addition, in the horizontal-movement wrinkle removing step S22, the garment C may be conveyed from one side to the other side of each of the conveyors 231, 232, 241, 242, and 243, such that one end of the garment C may be dropped from each of the conveyors 231, 232, 241, 242, and 243.

In this case, in the horizontal-movement wrinkle removing step S22, the garment may be conveyed by a distance corresponding to ⅓ or more and ⅔ or less of the length L of the garment, and particularly, the garment may be conveyed by a distance corresponding to ½ of the length L of the garment.

Meanwhile, in the horizontal-movement wrinkle removing step S22, when the reception of the detection signals in relation to the presence of the garment from the sensors SC3, SC5, and SC7 is stopped after the detection signal is received, the conveyance of the garment C is stopped, and the conveyance direction may be changed in order to convey the garment C from the other side to one side.

For example, when the rear end of the garment C passes through the third-conveyor-rear-end garment detection sensor SC3, the third-conveyor-rear-end garment detection sensor SC3 stops generating the detection signal. In this case, the rotation direction of the third conveyor motor M31 and the third conveyor motor M32 may be changed from the rearward direction to the forward direction in order to convey the garment C from the rear ends of the third conveyor 231 and the fourth conveyor 232 to the front ends of the third conveyor 231 and the fourth conveyor 232. At the same time, the rotation direction of the fifth conveyor motor M41 may be changed from the forward direction to the rearward direction in order to convey the tip of the garment C from the front end to the rear end of the fifth conveyor 241.

With this configuration, the garment C, which is being moved rearward by the third conveyor 231, is moved forward again, and the rear end of the garment C may be dropped to the outside of the front end of the third conveyor 231 by gravity (the weight of the garment C).

As another example, when the rear end of the horizontally folded garment C passes through the front end of the fifth conveyor 241, the fifth-conveyor-front-end garment detection sensor SC5 stops transmitting the detection signal. When the reception of the detection signal from the fifth-conveyor-front-end garment detection sensor SC5 is stopped, the rotation direction of the fifth conveyor motor M41, the sixth conveyor motor M42, and the seventh conveyor motor M43 may be changed from the rearward direction to the forward direction.

Therefore, the movement direction of the garment C, which is being conveyed to the rear end of the fifth conveyor 241, changed, such that the garment C is conveyed toward the front end of the seventh conveyor 243.

As still another example, when the tip of the garment C passes through the rear end of the seventh conveyor 243, the seventh-conveyor-rear-end garment detection sensor SC7 stops transmitting the detection signal. When the reception of the detection signal from the seventh-conveyor-rear-end garment detection sensor SC7 is stopped, the rotation direction of the fifth conveyor motor M41, the sixth conveyor motor M42, and the seventh conveyor motor M43 may be changed from the forward direction to the rearward direction.

Therefore, the movement direction of the garment C, which is being conveyed to the front end of the seventh conveyor 243, is changed, such that the garment C is conveyed toward the fifth conveyor 241.

With this configuration, the front end or the rear end of the garment C is dropped to the outside of the conveyor by gravity (weight), such that the wrinkles may be removed. Moreover, since the garment C is conveyed as the movement direction of the garment C is changed, an operation similar to an operation of shaking the garment may be implemented, such that the wrinkles may be removed by inertia.

Meanwhile, in the horizontal folding step S30, after the horizontal-movement wrinkle removing step S20, the horizontal folding may be performed on the garment C by rotating, in the opposite directions, the plurality of conveyors 231, 232, 241, 242, and 243 disposed in a forward/rearward direction. In this case, the detailed description of the horizontal folding step S30 may be replaced with the above-mentioned description.

A specific operational sequence of the garment folding machine 1 to which the method of controlling the garment folding machine according to the present disclosure is applied will be described below.

The method of controlling the garment folding machine according to the present disclosure includes a step S100 of removing a winkle of the garment C in the third folding layer 230, and a step S200 of removing a wrinkle of the garment C in the fourth folding layer 240.

First, the step S100 of removing a wrinkle of the garment C in the third folding layer 230 will be described below.

In the step S100 of removing a wrinkle of the garment C in the third folding layer 230, when the garment C is loaded from the loading unit 100 and enters the first folding layer 210, the control unit 400 operates the first conveyor motor M1 rearward and conveys the garment C from the front end to the rear end of the first conveyor 211 (S110).

In this case, for convenience, a portion of the garment C, which is enters the first conveyor 211 first in a conveyance direction, may be referred to as the tip, and a portion of the garment C, which passes through the first conveyor 211 last, may be referred to as the rear end.

In addition, in the garment folding machine 1, a direction in which the garment C is loaded into the loading unit 100 may be referred to as a front end of the garment folding machine 1, and a direction facing the front end of the garment folding machine 1 may be referred to as the rear end.

Meanwhile, the rotation direction of the conveyor will be described. A direction in which the garment C is conveyed from the rear end to the front end of the garment folding machine 1 may be referred to as the forward direction, and a direction in which the garment C is conveyed from the front end to the rear end of the garment folding machine 1 may be referred to as the rearward direction.

When the tip of the garment C passes through the rear end of the first conveyor 211, the control unit 400 operates the second conveyor motor M21 forward (S120). Therefore, the tip of the garment C is seated on the upper surface of the second conveyor 221, and the garment C is conveyed from the rear end to the front end of the second conveyor 221 by the forward rotation of the second conveyor 221.

Thereafter, when the tip of the garment C passes through the front end of the second conveyor 221, the second-conveyor-front-end garment detection sensor SC2 detects the presence of the garment C and transmits the detection signal. Further, the control unit 400 receives the detection signal from the second-conveyor-front-end garment detection sensor SC2 (S130).

When the control unit 400 receives the detection signal from the second-conveyor-front-end garment detection sensor SC2, the control unit 400 may operate the third conveyor motor M31 and the fourth conveyor motor M32 in the rearward direction and operate the fifth conveyor motor M41 in the forward direction (S141). As a result, the third conveyor 231 and the fourth conveyor 232 may rotate to convey the garment C, which is conveyed and loaded from the second conveyor 221, toward the rear end thereof. In addition, the fifth conveyor 241 may rotate in the forward direction in order to convey the garment C, which passes through the rear end of the fourth conveyor 232 and moves toward the fourth folding layer 240, toward the front end thereof.

Meanwhile, in the present embodiment, the control unit 400 may perform control such that a rotational speed of the third conveyor motor M31 is higher than a rotational speed of the second conveyor motor M21, and a rotational speed of the fifth conveyor motor M41 is higher than a rotational speed of the third conveyor motor M31. With this configuration, because the tip of the garment C is pulled, there is an effect of removing wrinkles of the entire garment C. In addition, when a length of the rear end of the garment C remaining on the second conveyor 221 is equal to or smaller than a predetermined length, the garment C may be pulled by the third conveyor 231 and dropped downward.

Therefore, according to the present disclosure, the rear end (one end) of the garment C, which passes through the front end of the second conveyor 221, may be dropped to the outside of the front end of the third conveyor 231 by gravity (weight).

As a result, according to the present disclosure, there is an effect of removing the wrinkles of the garment C in a similar manner to an operation of removing wrinkles of the garment by shaking the garment by a user.

Meanwhile, in another embodiment of the present disclosure, the control unit 400 may further operate the sixth conveyor motor M42 and the seventh conveyor motor M43 in the forward direction in addition to the fifth conveyor motor M41 (S141'). With this configuration, it is possible to convey the garment C having a length larger than twice a width in the forward/rearward direction of the garment folding machine 1.

When the third conveyor motor M31 operates, the control unit 400 may measure the time from the point in time at which the control unit 400 receives the detection signal from the third-conveyor-rear-end garment detection sensor SC3 to the point in time at which the reception of the detection signal is stopped (S142). Specifically, when the tip of the garment C reaches the third-conveyor-rear-end garment detection sensor SC3, the third-conveyor-rear-end garment detection sensor SC3 may transmit the detection signal to the control unit 400, and the control unit 400 may measure the time from the point in time at which the control unit 400 receives the detection signal from the third-conveyor-rear-end garment detection sensor SC3 to the point in time at which the third-conveyor-rear-end garment detection sensor SC3 stops transmitting the detection signal (the measured time may be referred to as the garment passage time Tc).

Therefore, the present disclosure may calculate the length L1 of the garment C using the garment passage time Tc. For example, the distance by which the third conveyor 231 rotates for the garment passage time Tc may be calculated by multiplying the garment passage time Tc by the conveying speed Vc of the third conveyor 231, and the calculated distance may mean the length L1 of the garment C. Meanwhile, as another example, in a case in which the third conveyor 231 and the garment C may slip relative to each other because of the material of the garment C, the length of the garment C may be calculated by applying a correction value in accordance with the material.

When the rear end of the garment C passes through the third-conveyor-rear-end garment detection sensor SC3, the third-conveyor-rear-end garment detection sensor SC3 stops generating the detection signal (S150). In this case, the control unit 400 may change the rotation direction of the third conveyor motor M31 and the third conveyor motor M32 from the rearward direction to the forward direction in order to convey the garment C from the rear ends of the third conveyor 231 and the fourth conveyor 232 to the front ends of the third conveyor 231 and the fourth conveyor 232. At the same time, the control unit 400 may change the rotation direction of the fifth conveyor motor M41 from the forward direction to the rearward direction in order to convey the tip of the garment C from the front end to the rear end of the fifth conveyor 241.

With this configuration, the garment C, which is being moved rearward by the third conveyor 231, is moved forward again, and the rear end of the garment C may be dropped to the outside of the front end of the third conveyor 231 by gravity (the weight of the garment C).

As a result, according to the present disclosure, it is possible to remove the wrinkle of the garment C once more by gravity.

Meanwhile, the control unit 400 may stop the third conveyor motor M31, the fourth conveyor motor M32, and the fifth conveyor motor M41 after maintaining the operations of the third conveyor motor M31, the fourth conveyor motor M32, and the fifth conveyor motor M41 for a predetermined operating time Td. In this case, the operating time Td of the third conveyor motor M31, the fourth conveyor motor M32, and the fifth conveyor motor M41 may be ⅓ or more and ⅔ or less of the garment passage time Tc, and particularly, ½ of the garment passage time Tc (S170).

With this configuration, the present disclosure may dispose a middle portion of the garment C, which corresponds to half the length of the garment C, at the position of the first folding gap G1 and may remove the wrinkle at the rear end of the garment C.

When the middle portion of the garment C is disposed at the position of the first folding gap G1, the control unit 400 may operate the third conveyor motor M31 to convey the rear end (one end) of the garment C from the front end to the rear end of the third conveyor 231 and may operate the fourth conveyor motor M32 to convey the tip (the other end) of the garment C from the rear end to the front end of the fourth conveyor 232 in order to perform the horizontal folding on the garment C (S180). Hereinafter, the specific description of the horizontal folding process may be replaced with the above-mentioned description.

Next, in the step S200 of removing the winkle of the garment C in the fourth folding layer 240, the control unit 400 conveys the garment C, which is horizontally folded in the third folding layer 230 and passes through the first folding gap G1, toward the rear end of the fifth conveyor 241. That is, the control unit 400 operates the fifth conveyor motor M41, the sixth conveyor motor M42, and the seventh conveyor motor M43 rearward, and the garment C, which passes through the first folding gap G1 and is seated on the upper surface of the seventh conveyor 243, is conveyed toward the rear end of the fifth conveyor 241 after passing through the seventh conveyor 243 and the sixth conveyor 242 (S210).

Meanwhile, the garment folding machine 1 according to the present disclosure may further include the fifth-conveyor-front-end garment detection sensor SC5 disposed at the front end of the fifth conveyor 241 and configured to detect whether the garment C is present at the target position and generate a detection signal.

When the tip of the garment C, which is horizontally folded in the third folding layer 230, is moved to the front end of the fifth conveyor 241 via the seventh conveyor 243, the fifth-conveyor-front-end garment detection sensor SC5 may transmit the detection signal, and the control unit 400 may receive the detection signal from the fifth-conveyor-front-end garment detection sensor SC5.

Next, when the rear end of the horizontally folded garment C passes through the front end of the fifth conveyor 241, the fifth-conveyor-front-end garment detection sensor SC5 stops transmitting the detection signal (S220), and the reception of the detection signal from the fifth-conveyor-front-end garment detection sensor SC5 by the control unit 400 is stopped.

When the reception of the detection signal from the fifth-conveyor-front-end garment detection sensor SC5 is stopped, the control unit 400 may change the rotation direction of the fifth conveyor motor M41, the sixth conveyor motor M42, and the seventh conveyor motor M43 from the rearward direction to the forward direction (S230).

Therefore, the movement direction of the garment C, which is being conveyed to the rear end of the fifth conveyor 241, is changed, such that the garment C is conveyed toward the front end of the seventh conveyor 243.

With this configuration, the garment C, which is being moved rearward by the fifth conveyor 241, is moved forward again, and the tip of the garment C may be dropped to the outside of the rear end of the fifth conveyor 241 by gravity (weight), such that the wrinkle may be removed.

Moreover, in the present disclosure, the movement direction of the garment C, which is being conveyed to the rear end of the fifth conveyor 241, is changed, such that the garment C is conveyed toward the front end of the seventh conveyor 243. As a result, it is possible to implement an effect of removing the wrinkles by inertia in a similar manner to an operation of shaking the garment.

When the rear end of the garment C, of which the conveyance direction is changed, reaches the rear end of the seventh conveyor 243 via the fifth conveyor 241 and the sixth conveyor 242, the seventh-conveyor-rear-end garment detection sensor SC7 transmits the detection signal, and the control unit 400 may receive the detection signal from the seventh-conveyor-rear-end garment detection sensor SC7 (S240).

The control unit 400 may measure the time from the point in time at which the control unit 400 receives the detection signal from the seventh-conveyor-rear-end garment detection sensor SC7 to the point in time at which the reception of the detection signal from the seventh-conveyor-rear-end garment detection sensor SC7 is stopped (S250). Further, the calculated time may be referred to as the garment passage time Tc2.

Therefore, the present disclosure may calculate the length L2 of the horizontally folded garment C using the garment passage time Tc2. For example, the distance by which the seventh conveyor 243 rotates for the garment passage time Tc2 may be calculated by multiplying the garment passage time Tc2 by the conveying speed Vc of the seventh conveyor 243, and the calculated distance may mean the length L2 of the horizontally folded garment C. Meanwhile, as another example, in a case in which the seventh conveyor 243 and the garment C may slip relative to each other because of the material of the garment C, the length of the garment C may be calculated by applying a correction value in accordance with the material.

Next, when the tip of the garment C passes through the rear end of the seventh conveyor 243, the seventh-conveyor-rear-end garment detection sensor SC7 stops transmitting the detection signal (S260), and the reception of the detection signal from the seventh-conveyor-rear-end garment detection sensor SC7 by the control unit 400 is stopped.

When the reception of the detection signal from the seventh-conveyor-rear-end garment detection sensor SC7 is stopped, the control unit 400 may change the rotation direction of the fifth conveyor motor M41, the sixth conveyor motor M42, and the seventh conveyor motor M43 from the forward direction to the rearward direction (S270).

Therefore, the movement direction of the garment C, which is being conveyed to the front end of the seventh conveyor 243, is changed, such that the garment C is conveyed toward the fifth conveyor 241.

With this configuration, the garment C, which is being moved forward by the seventh conveyor 243, is moved rearward again, and the rear end of the garment C may be dropped to the outside of the front end of the seventh conveyor 243 by gravity (weight), such that the wrinkle may be removed.

Moreover, in the present disclosure, the movement direction of the garment C, which is being conveyed to the front end of the seventh conveyor 243, is changed, such that the garment C is conveyed toward the fifth conveyor 241. As a result, it is possible to implement an effect of removing the wrinkles by inertia in a similar manner to an operation of shaking the garment.

Meanwhile, in the present disclosure, in a case in which the garment C is set in advance to be subjected to the ½ or ⅓ horizontal folding, the horizontal folding may be performed in a preset manner (S280). That is, in order to perform the horizontal folding on the garment C, the control unit 400 may control the sixth conveyor motor M42 so that the rotation direction of the sixth conveyor 242 is opposite to the rotation direction of the fifth conveyor 241 or control the sixth conveyor motor M42 so that the rotation direction of the sixth conveyor 242 is opposite to the rotation direction of the seventh conveyor 243. Meanwhile, in order to avoid the repeated description, the detailed description of the horizontal folding in the fourth folding layer 240 may be replaced with the above-mentioned description.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

DESCRIPTION OF REFERENCE NUMERALS

1: Garment folding machine
100: Loading unit
200: Folding unit
210: First folding layer
211: First conveyor
M1: First conveyor motor
SC1: First-conveyor-rear-end garment detection sensor
220: Second folding layer
221: Second conveyor
M21: Second conveyor motor
SC2: Second-conveyor-front-end garment detection sensor
230: Third folding layer
231: Third conveyor
M31: Third conveyor motor
SC3: Third-conveyor-rear-end garment detection sensor
232: Fourth conveyor
M32: Fourth conveyor motor
240: Fourth folding layer
241: Fifth conveyor
M41: Fifth conveyor motor
SC5: Second-conveyor-front-end garment detection sensor
242: Sixth conveyor
M42: Sixth conveyor motor
243: Seventh conveyor
M43: Seventh conveyor motor SC7: Seventh-conveyor-rear-end garment detection sensor

400: Control unit

What is claimed is:

1. A garment folding machine comprising:

a frame unit configured to define an external framework;

a loading unit into which a garment is received;

a folding unit configured to convey and fold the garment;

an unloading unit configured to collect the garment folded by the folding unit; and a control unit configured to control the folding unit, wherein the folding unit comprises:

a first folding layer;

a second folding layer disposed below the first folding layer and configured to perform vertical folding on the garment; and a third folding layer disposed below the second folding layer and configured to perform horizontal folding on the garment, wherein the third folding layer comprises:

a third conveyor configured to convey the garment, passing through the second folding layer, to a front end or a rear end of the third conveyor; and a third conveyor motor configured to provide driving power to the third conveyor, wherein the control unit is configured to operate the third conveyor motor to drop one end of the garment to an outside of the front end of the third conveyor, wherein the second folding layer comprises:

a second conveyor configured to convey the garment, passing through the first folding layer, from a rear end to a front end of the second conveyor;

a second conveyor motor configured to provide driving power to the second conveyor; and a second-conveyor-front-end garment detection sensor disposed at the front end of the second conveyor and configured to (i) detect whether the garment has reached a target position and (ii) generate a detection signal, and wherein the control unit is configured to, based on the detection signal being received at the control unit from the second-conveyor-front-end garment detection sensor, operate the third conveyor motor.

2. The garment folding machine of claim 1, wherein the third folding layer further comprises a third-conveyor-rear-end garment detection sensor disposed at the rear end of the third conveyor and configured to (i) detect whether the garment has reached the target position and (ii) generate a detection signal, and wherein the control unit is configured to calculate a length of the garment using a garment passage time determined by measuring a time from a point in time at which the control unit begins to receive the detection signal from the third-conveyor-rear-end garment detection sensor to a point in time at which the reception of the detection signal is stopped.

3. The garment folding machine of claim 2, wherein the control unit is configured to, based on the reception of the detection signal from the third-conveyor-rear-end garment detection sensor being stopped, change a rotation direction of the third conveyor motor to convey the garment from the rear end to the front end of the third conveyor.

4. The garment folding machine of claim 3, wherein the control unit operates the third conveyor motor to convey the garment from the rear end to the front end of the third conveyor, and an operating time of the third conveyor motor is ⅓ or more and ⅔ or less of the garment passage time.

5. The garment folding machine of claim 4, wherein the third folding layer further comprises:

a fourth conveyor disposed at a rear side of the third conveyor and configured to convey the garment or perform horizontal folding on the garment; and a fourth conveyor motor configured to provide driving power to the fourth conveyor, and wherein the control unit is configured to, based on the reception of the detection signal from the third-conveyor-rear-end garment detection sensor being stopped, operate the fourth conveyor motor to convey the garment from a rear end to a front end of the fourth conveyor, and an operating time of the fourth conveyor motor is ⅓ or more and ⅔ or less of the garment passage time.

6. The garment folding machine of claim 5, wherein the control unit is configured to, during the horizontal folding, operate (i) the third conveyor motor to convey one end of the garment from the front end to the rear end of the third conveyor and (ii) the fourth conveyor motor to convey the other end of the garment from the rear end to the front end of the fourth conveyor.

7. The garment folding machine of claim 1, wherein the folding unit further comprises a fourth folding layer disposed below the third folding layer and configured to perform horizontal folding on the garment, wherein the fourth folding layer comprises:

a fifth conveyor configured to convey the garment to a front end or a rear end of the fifth conveyor thereof;

a fifth conveyor motor configured to provide driving power to the fifth conveyor; and a fifth-conveyor-front-end garment detection sensor disposed at the front end of the fifth conveyor and configured to (i) detect whether the garment has reached the target position and (ii) generate a detection signal, wherein the control unit is configured to operate the fifth conveyor motor to convey the garment to the rear end of the fifth conveyor, and wherein the control unit is configured to, based on the reception of the detection signal from the fifth-conveyor-front-end garment detection sensor being stopped, change a rotation direction of the fifth conveyor motor.

8. The garment folding machine of claim 7, wherein the fourth folding layer further comprises:

a seventh conveyor disposed at a front side of the fifth conveyor and configured to convey the garment to a front end or a rear end of the seventh conveyor;

a seventh conveyor motor configured to provide driving power to the seventh conveyor; and a seventh-conveyor-rear-end garment detection sensor disposed at the rear end of the seventh conveyor and configured to (i) detect whether the garment has reached the target position and (ii) generate a detection signal, wherein the control unit is configured to operate the seventh conveyor motor to convey the garment to the front end of the seventh conveyor, and wherein the control unit is configured to, based on the reception of the detection signal from the seventh-conveyor-rear-end garment detection sensor being stopped, change a rotation direction of the seventh conveyor motor.

9. The garment folding machine of claim 8, wherein the fourth folding layer further comprises:

a sixth conveyor that is disposed between the fifth conveyor and the seventh conveyor and that is configured to convey the garment or perform horizontal folding on the garment; and a sixth conveyor motor configured to provide driving power to the sixth conveyor, and wherein the control unit is configured to perform the horizontal folding on the garment by controlling (i) the sixth conveyor motor so that a rotation direction of the sixth conveyor is opposite to a rotation direction of the fifth conveyor or (ii) the sixth conveyor motor so that a rotation direction of the sixth conveyor is opposite to a rotation direction of the seventh conveyor.

* * * * *